US006701697B2

(12) United States Patent
Savigny et al.

(10) Patent No.: US 6,701,697 B2
(45) Date of Patent: Mar. 9, 2004

(54) CAROUSEL BAGGER

(75) Inventors: Edward B. Savigny, Newfane, NY (US); Michael D. Seitz, Lockport, NY (US)

(73) Assignee: Ag-Pak, Inc., Gasport, NY (US)

( * ) Notice: Subject to any disclaimer, the term of this patent is extended or adjusted under 35 U.S.C. 154(b) by 0 days.

(21) Appl. No.: 10/012,186

(22) Filed: Dec. 4, 2001

(65) Prior Publication Data

US 2003/0101686 A1 Jun. 5, 2003

(51) Int. Cl.[7] ..... B65B 1/06

(52) U.S. Cl. ..... 53/570; 53/247; 53/253; 53/260

(58) Field of Search ..... 53/570, 249, 250, 53/253, 260, 502, 247

(56) References Cited

U.S. PATENT DOCUMENTS

| | | | | |
|---|---|---|---|---|
| 505,858 A | * | 10/1893 | Smyser | 53/253 |
| 945,572 A | | 1/1910 | Murray | |
| 2,510,541 A | | 6/1950 | Beeson | |
| 3,064,406 A | * | 11/1962 | Kennedy et al. | 53/247 |
| 3,091,903 A | * | 6/1963 | Kammerer | 53/253 |
| 3,161,003 A | | 12/1964 | Grintz | |
| 3,270,485 A | | 9/1966 | Knepper | |
| 3,458,970 A | | 8/1969 | Reid et al. | |
| 4,235,067 A | * | 11/1980 | Parsons | 53/253 |
| 4,534,156 A | * | 8/1985 | Smith | 53/260 |
| 4,570,419 A | * | 2/1986 | Tinsley | 53/260 |
| 4,716,714 A | | 1/1988 | Tisma | |
| 5,001,889 A | | 3/1991 | Mueller | |
| 5,048,266 A | | 9/1991 | Wiekowicz | |
| 5,265,402 A | * | 11/1993 | Lerner et al. | 53/570 |
| 5,331,792 A | | 7/1994 | Kitchen | |
| 5,555,709 A | | 9/1996 | Savigny et al. | |
| 5,762,116 A | * | 6/1998 | Moore | 53/253 |
| 6,044,617 A | | 4/2000 | Finkowski et al. | |
| 6,094,891 A | | 8/2000 | Savigny et al. | |

FOREIGN PATENT DOCUMENTS

| | | | | |
|---|---|---|---|---|
| JP | 05178314 A | * | 7/1993 | 53/260 |

OTHER PUBLICATIONS

Clamping structure exclusive of combined chute and clamping members 90, 91 is not novel, as stated on p. 17 of the specification.

The subject matter of FIG. 42, as described in the second full paragraph starting on p. 22 of the specification, is known in the art.

* cited by examiner

*Primary Examiner*—Stephen F. Gerrity
(74) *Attorney, Agent, or Firm*—Joseph P. Gastel

(57) ABSTRACT

A carousel bagger including a plurality of troughs each having sides fixed to a rotatable table with a pivotable bottom wall pivoted from a lower product-receiving position to a higher product-dumping position in response to actuation by a linkage running on a cam track as the table rotates. The bottom wall has two longitudinal sections with an obtuse angle therebetween which tends to cause the product to travel in a single file to thereby avoid bridging. The trough dumps product through combined chute and bag-clamping members having sides with outwardly flared upper portions which also tends to avoid bridging.

66 Claims, 19 Drawing Sheets

FIG. 3
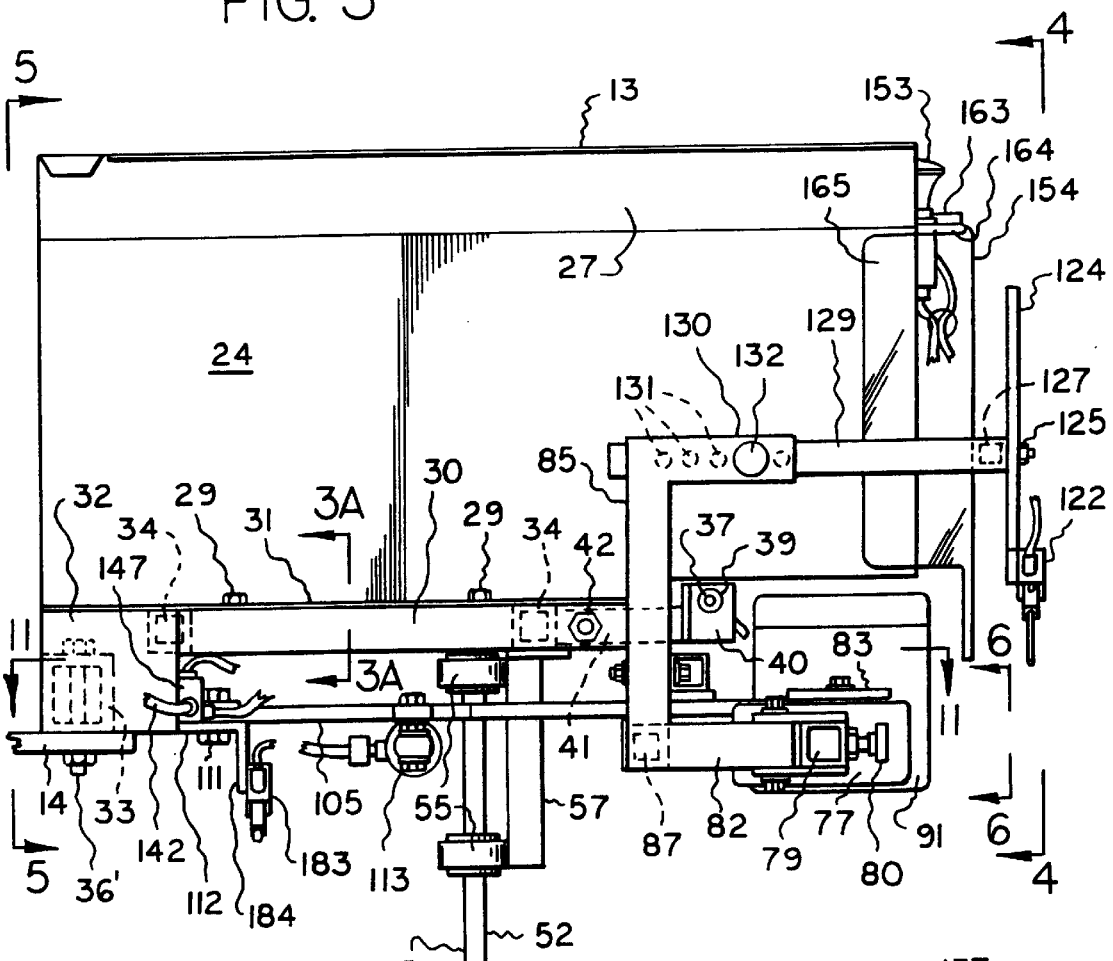
FIG. 3A
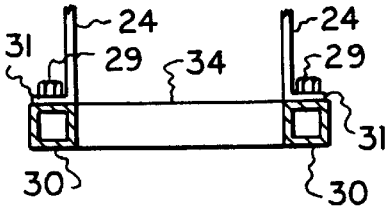
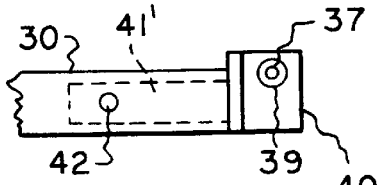
FIG. 3B
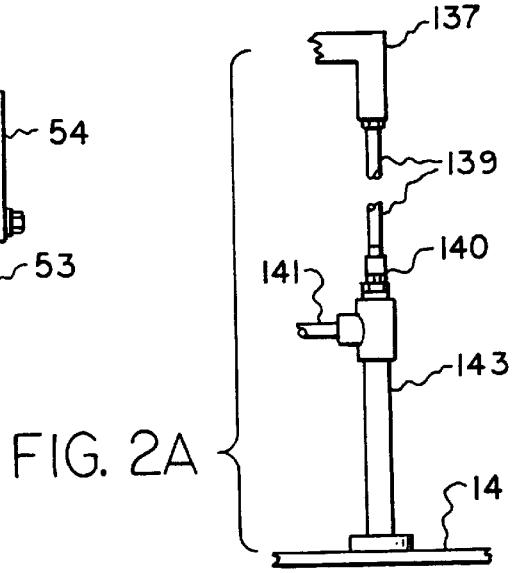
FIG. 2A

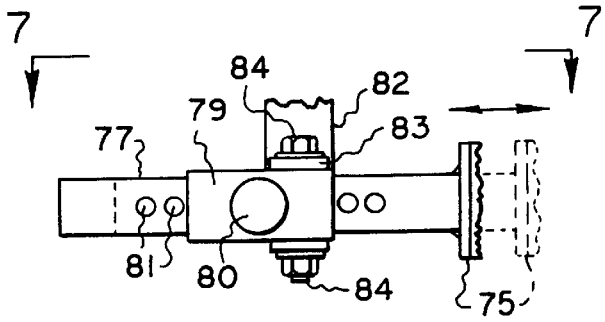
FIG. 6
FIG. 7
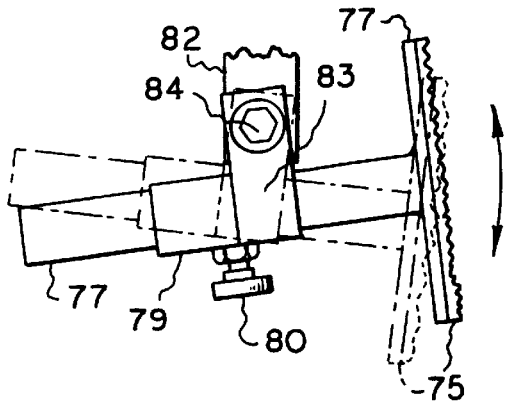
FIG. 8
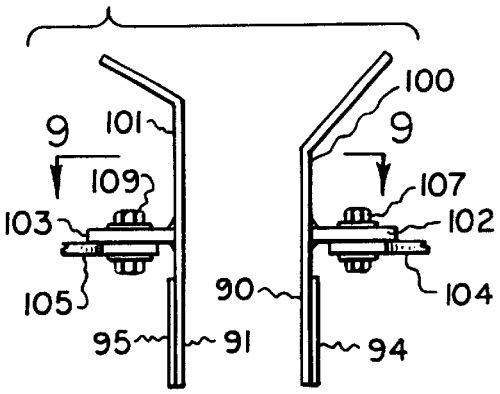
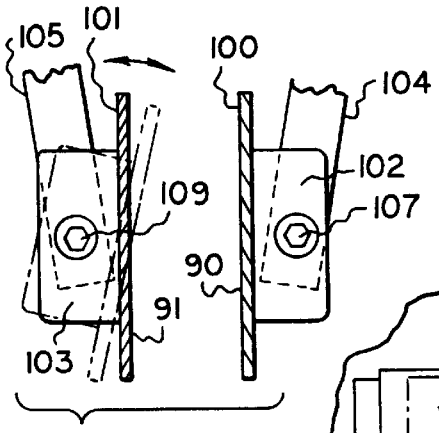
FIG. 9
FIG. 10
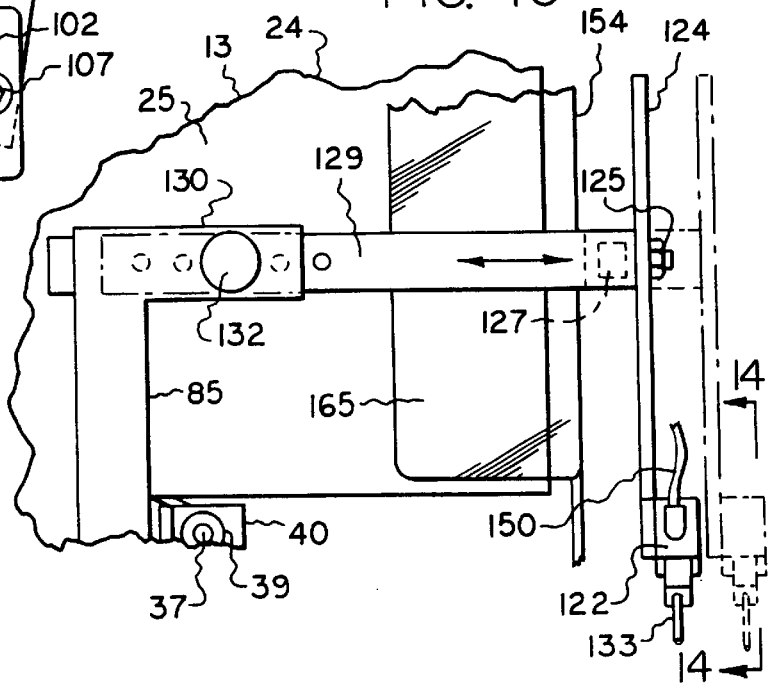

FIG. 28
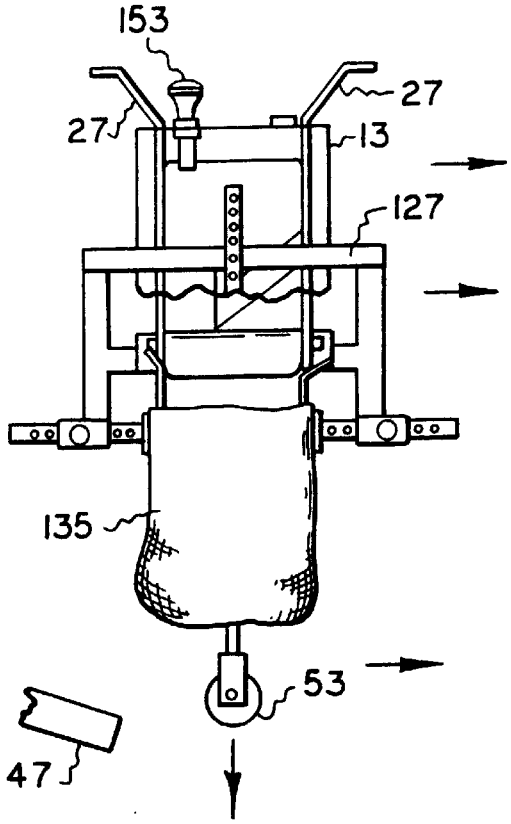
FIG. 29
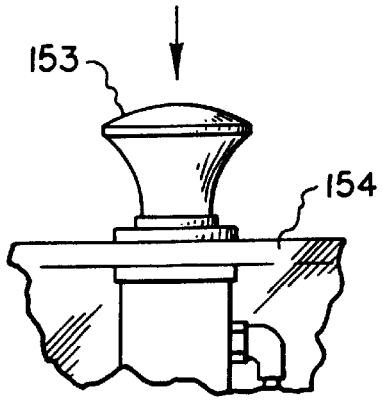
FIG. 30
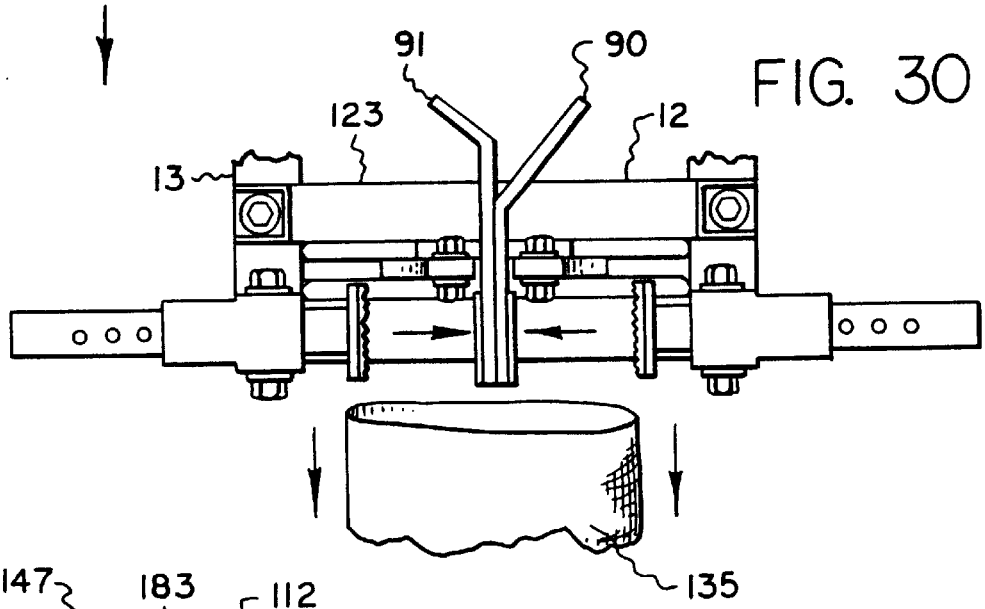
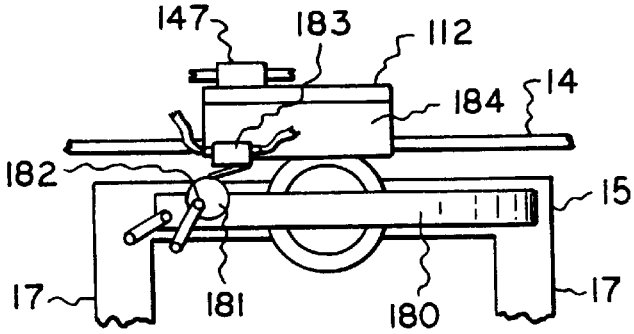
FIG. 31

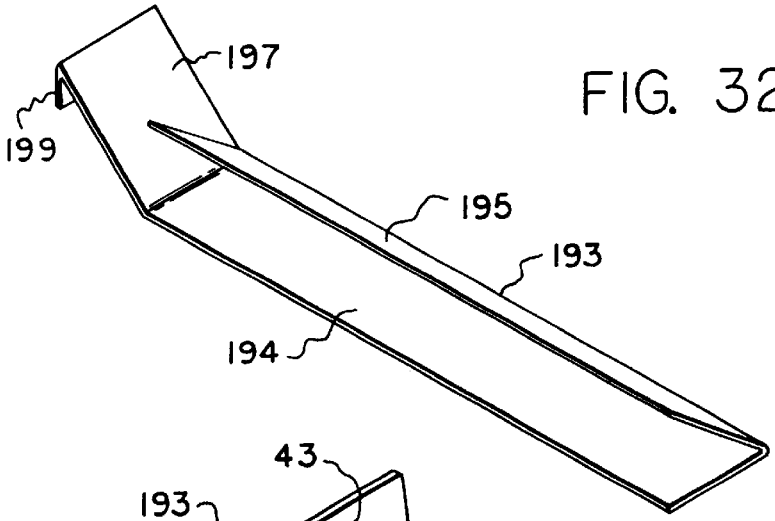
FIG. 32
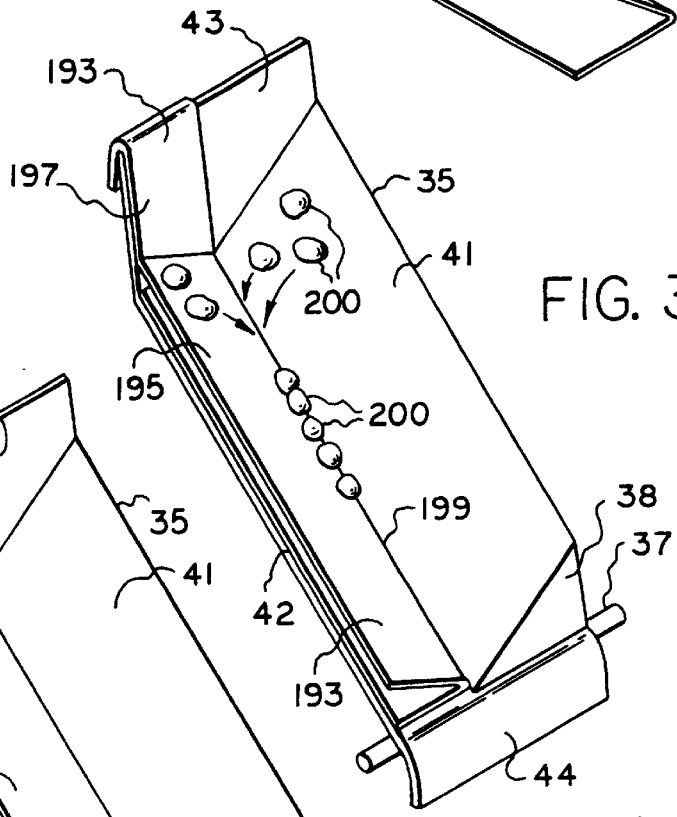
FIG. 33A
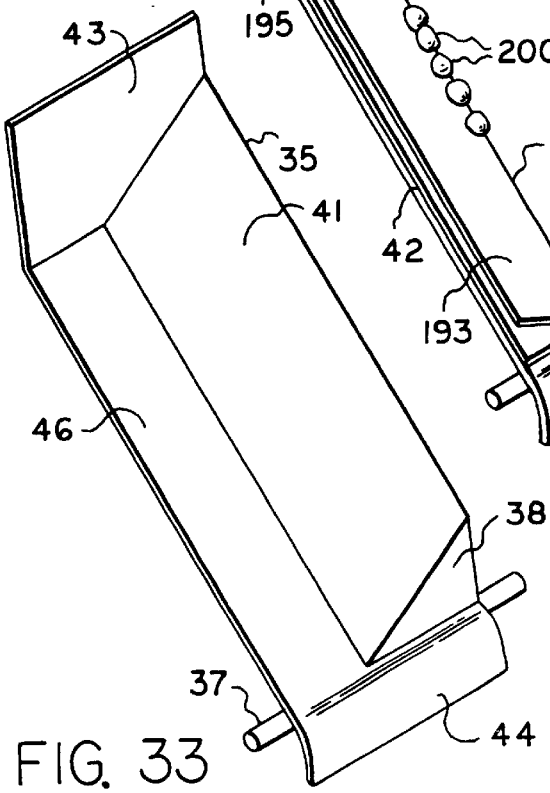
FIG. 33
FIG. 34
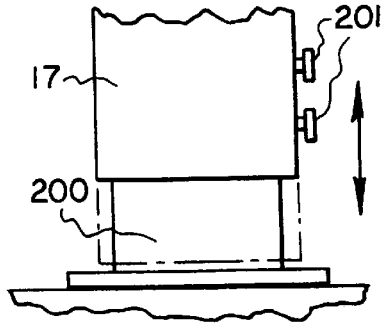

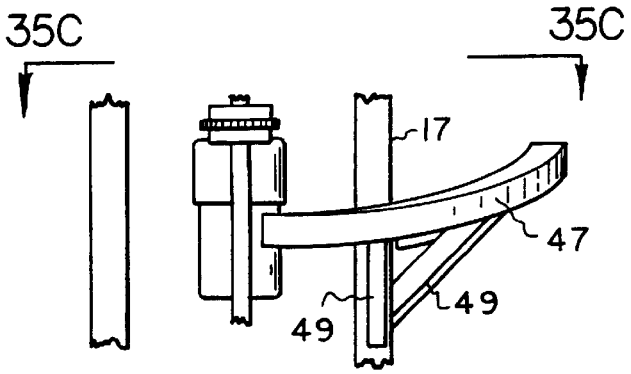
FIG. 35B
FIG. 35C
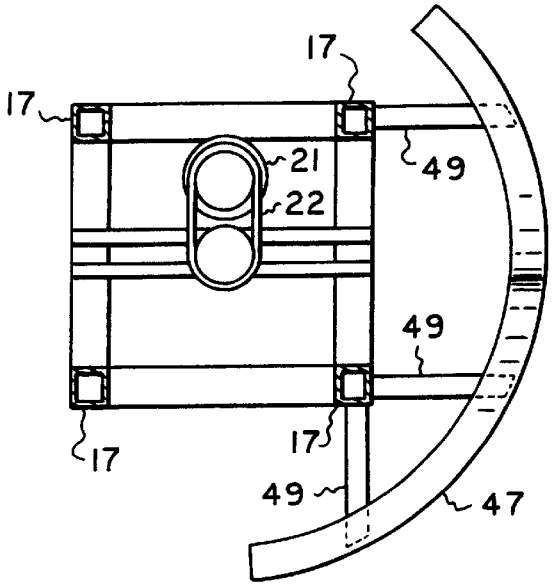
FIG. 36C
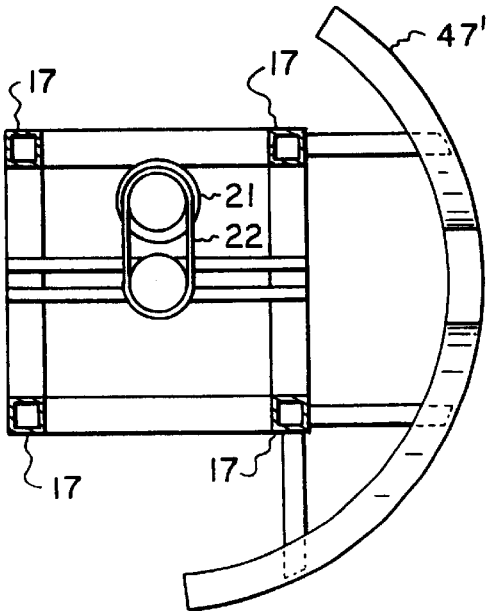
FIG. 36B
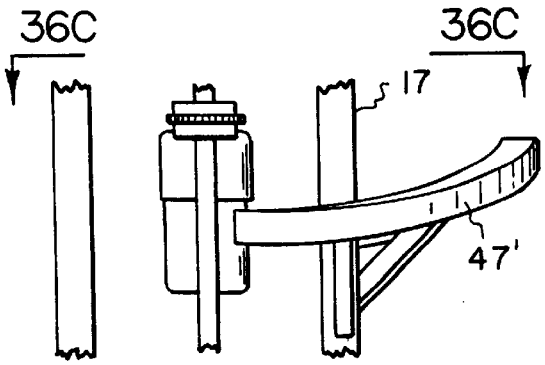

CAROUSEL BAGGER

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention relates to a carousel bagger with chutes having tiltable bottom walls.

By way of background, there are in existence numerous types of carousel baggers. However, various types of carousel baggers were either relatively complicated and expensive or they required complex mechanisms associated with their troughs for the purpose of conveying the product to associated bags.

BRIEF SUMMARY OF THE INVENTION

It is one object of the present invention to provide an improved carousel bagger which is relatively simple in construction.

Another object of the present invention is to provide an improved carousel bagger having a simple and efficient trough construction.

A further object of the present invention is to provide a carousel bagger having a trough construction which tends to align the product being bagged so that it flows smoothly into an associated bag.

Yet another object of the present invention is to provide an improved carousel bagger having changeable trough configurations to suit different types of products being bagged.

A still further object of the present invention is to provide an improved carousel bagger having improved combined chute and bag-clamping members for supporting a bag which receives product. Other objects and attendant advantages of the present invention will be readily perceived hereafter.

The present invention relates to a carousel bagger comprising a frame, a rotatable table mounted on said frame, a plurality of troughs, side walls on said troughs fixedly mounted on said table, inner and outer ends on said troughs, a bottom wall in each of said troughs, a pivotal mounting securing each of said bottom walls relative to said side walls proximate said outer ends of each of said troughs, a cam track, and a linkage between said cam track and each of said bottom walls for pivoting said bottom walls about said pivotal mounting.

The present invention also relates to a carousel bagger comprising a frame, a rotatable table mounted on said frame, a plurality of troughs mounted on said table, inner and outer ends on said troughs, side walls on said troughs, a bottom wall in each of said troughs, a pivotal mounting securing each of said bottom walls proximate said outer ends of each of said troughs, a cam track, and a linkage between said cam track and each of said bottom walls for pivoting said bottom walls about said pivotal mounting, said bottom wall comprising two elongated sections which are at an angle to each other longitudinally of said bottom wall.

The present invention also relates to a bottom wall for a trough having a length and a width, first and second sections on said bottom wall extending lengthwise thereof, and an angle between said first section and said second section.

The present invention also relates to an improvement in a bagger having a trough, spaced outer bag-clamping members, and a linkage mounting movable first and second combined chute and bag-clamping members within said spaced outer bag-clamping members, the improvement comprising first and second lower substantially vertical side portions on said first and second combined chute and bag-clamping members, and an outwardly inclined upper portion on at least one of said first and second lower substantially vertical side portions.

The present invention also relates to a carousel bagger comprising a frame, a rotatable table mounted on said frame, a plurality of troughs, side walls on said troughs fixedly mounted on said table, a bottom wall in each of said troughs, and a pivotal mounting securing each of said bottom walls relative to said side walls.

The present invention also relates to a carousel bagger comprising a frame, a rotatable table mounted on said frame, a plurality of troughs mounted on said table, a bottom wall on each of said troughs, a pivotal mounting securing each of said bottom walls relative to said side walls, a cam track having an entry portion, a linkage between said cam track and each of said bottom walls for pivoting said bottom walls about said pivotal mounting, and a wheel proximate said entry portion.

The present invention also relates to a carousel bagger comprising a frame, a rotatable table mounted on said frame, a plurality of troughs, side walls on said troughs fixedly mounted on said table, a bottom wall in each of said troughs, a pivotal mounting securing each of said bottom walls relative to said side walls, spaced outer bag-clamping members, movable first and second inner combined chute and bag-clamping members located within said first and second outer bag-clamping members, and first and second opposed chute sides on said first and second inner combined chute and bag-clamping members.

The present invention also relates to a carousel bagger comprising a frame, a rotatable table mounted on said frame, a plurality of troughs, side walls on said troughs, bottom walls on said troughs, a pivotal mounting securing each bottom wall relative to said side walls, a cam track, a linkage between said cam track and said bottom wall for pivoting said bottom wall about said pivotal mounting, and a bump-providing member secured to said cam track.

The various aspects of the present invention will be more fully understood when the following portions of the specification are read in conjunction with the accompanying drawings wherein:

BRIEF DESCRIPTION OF THE SEVERAL VIEWS OF THE DRAWING

FIG. 2A is an enlarged fragmentary view of a portion of FIG. 2 showing the conduit for conducting compressed air to the carousel;

FIG. 3 is an enlargement of a portion of FIG. 2 and showing a side elevational view of the produce-receiving trough;

FIG. 3A is a fragmentary cross sectional view taken substantially along line 3A—3A of FIG. 3;

FIG. 3B is a fragmentary enlarged portion of FIG. 3;

FIG. 6 is a fragmentary side elevational view of the structure for adjusting the stationery pads of the bag clamping structure;

FIG. 7 is a fragmentary plan view taken substantially in the direction of arrows 7—7 of FIG. 6;

FIG. 8 is an end elevational view of the combined movable chute and pad members;

FIG. 9 is a fragmentary cross sectional view taken substantially along line 9—9 of FIG. 8;

FIG. 10 is an enlarged fragmentary side elevational view of the structure for adjusting the position of the end surface of the trough for accommodating bags of different sizes;

FIG. 28 is a view taken in the direction of arrows 28—28 of FIG. 1 and showing the loaded bag after the trough leaves the cam track and the bottom of the trough returns to its lowermost position;

FIG. 29 is a fragmentary enlarged portion of FIG. 28 showing the manual clamp release;

FIG. 30 is a fragmentary enlarged view showing the combined chute and clamping members returned to their bag loading position with the loaded bag being released;

FIG. 31 is a fragmentary view taken substantially in the direction of arrows 31—31 of FIG. 2 and showing the automatic bag release control;

FIG. 32 is a perspective view of a trough-modifying member which can be mounted on the bottom wall of the trough to confine small items into a more aligned path for loading into a smaller diameter bag;

FIG. 33 is a perspective view of the bottom wall of the trough;

FIG. 33A is a perspective view showing the trough of FIG. 33 with a trough-modifying member which can be selectively mounted on the bottom wall of the trough to modify its produce-conducting characteristic;

FIG. 34 is a fragmentary view showing structure for adjusting the height of the carousel frame;

FIG. 35B is a view taken substantially in the direction of arrows 35B—35B of FIG. 35A;

FIG. 35C is a view taken substantially in the direction of arrows 35C—35C of FIG. 35B;

FIG. 36B is a view taken substantially in the direction of arrows 36B—36B of FIG. 36A;

FIG. 36C is a view taken substantially in the direction of arrows 36C—36C of FIG. 36B;

DETAILED DESCRIPTION OF THE INVENTION

Figure 18:
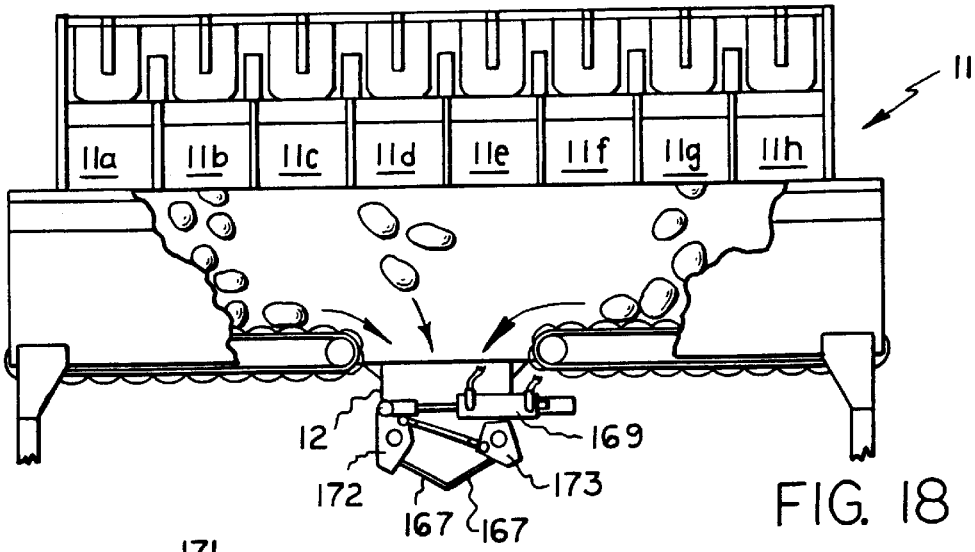
FIG. 18 is a partially broken away view taken substantially in the direction of arrows 18—18 of FIG. 2 and showing produce being dumped into the hopper from the weigher.

The improved carousel bagger 10 of the present invention is associated with a multi-bay weigher 11 (FIGS. 1, 2 and 18–21) which periodically opens a computer-selected number of its bays 11*a*, 11*b*, 11*c*, 11*d*, 11*g* . . . etc. (FIG. 18) to provide a predetermined weight of produce, such as potatoes, to a hopper 12 which will be described in detail hereafter. The weigher 11, in this instance, is one which is manufactured by Newtec of Denmark.

Figure 35A:
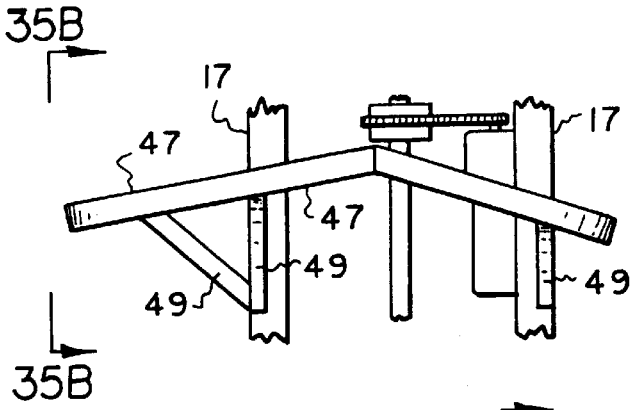
FIG. 35A is a fragmentary side elevational view of one form of cam track.

The carousel bagger 10 includes eight troughs 13 mounted on a rotating table top 14 which is mounted on frame 15 having four legs 17 (FIGS. 2, 35C, 36C) which mount a horizontal square frame portion 19 having four sides each mounting a roller 20. Rotatable table 14 rests on rollers 20 and it is driven by a motor 21 having a chain drive 22 to shaft 23 which is keyed to rotatable table 14. Suitable bearings, not shown, are provided for shaft 23. The structure of frame 15, rotatable table 14 and associated structure is described in detail in U.S. Pat. No. 5,555,709 which is incorporated herein by reference.

Each trough 13 includes opposed vertical sides 24 which have outwardly flared upper portions 27. Sides 24 (FIG. 3A) have flanges 31 at their lower ends which are bolted to tubular frame members 30. The ends of tubular members 30 are welded to upstanding plates 32 (FIG. 3) which are welded to tubular cross member 33 (FIGS. 3, 11 and 15) which is bolted to rotatable table 14 by bolts 36'. A pair of tubular struts 34 (FIGS. 3 and 3A) extend between tubular members 30 in the same manner as tubular struts 66 of FIG. 8D of U.S. Pat. No. 5,555,709.

The trough 13 also includes a bottom wall 35 (FIGS. 21, 22, 22A, 24, 25, 26, 27, 33 and 39). Bottom wall 35 includes a planar underplate 36 (FIG. 22) which extends for the entire length of trough 13. A shaft 37 is welded to the underside of underplate 36. The opposite ends of shaft 37 are pivotally mounted in bearings 39 (FIGS. 3 and 4) which are mounted on plates 40 welded to tubular members 41' (FIG. 3B) telescopically positioned within tubular members 30 and retained in position by a set screw 42 (FIGS. 3 and 3B). Bottom wall 35 also includes two sections 41 and 42 which extend lengthwise of bottom wall 35 (FIGS. 22, 22A, 33 and 38) and which have an upstanding planar back 43 at their inner ends, namely, the end closest to the center of table 14. An obtuse angle (FIG. 22) extends between sections 41 and 42. However, for certain types of produce or other products, the angle between sections 41 and 42 may be a right angle or even an acute angle. A downwardly extending lip 44 (FIG. 33A) is located at the outer end of plate 36 and is essentially a continuation of section 42. A triangular plate 38 closes the space between bottom wall section 41 and plate 36. Also, a plate 46 (FIG. 22) extends between the edge of plate 36 and the top edge of section 41 for the entire length of underplate 36.

Figure 1:
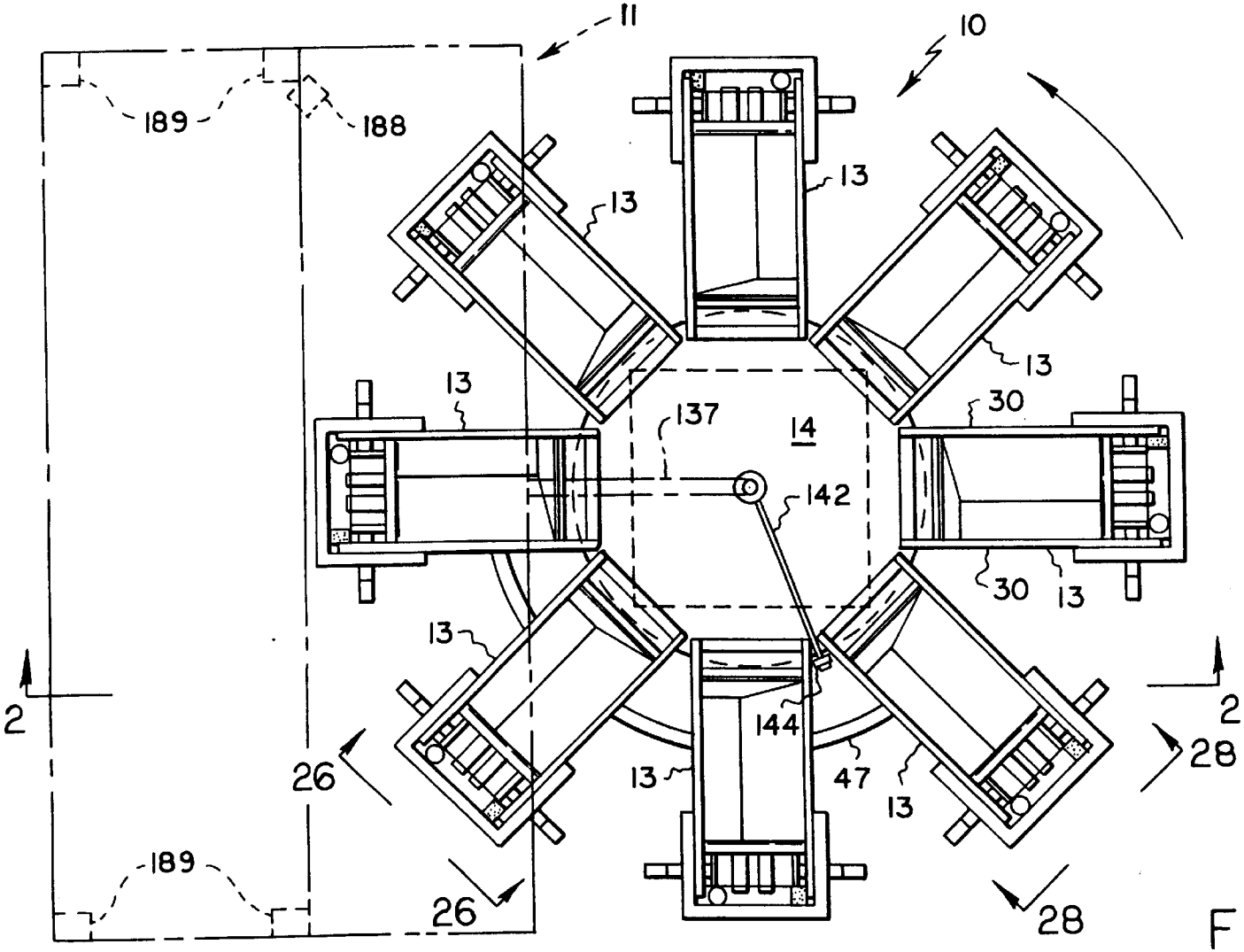
FIG. 1 is a plan view of the improved carousel bagger of the present invention taken substantially in the direction of arrows 1—1 of FIG. 2 with certain parts omitted and also showing in phantom the weighing machine associated therewith.
Figure 2:
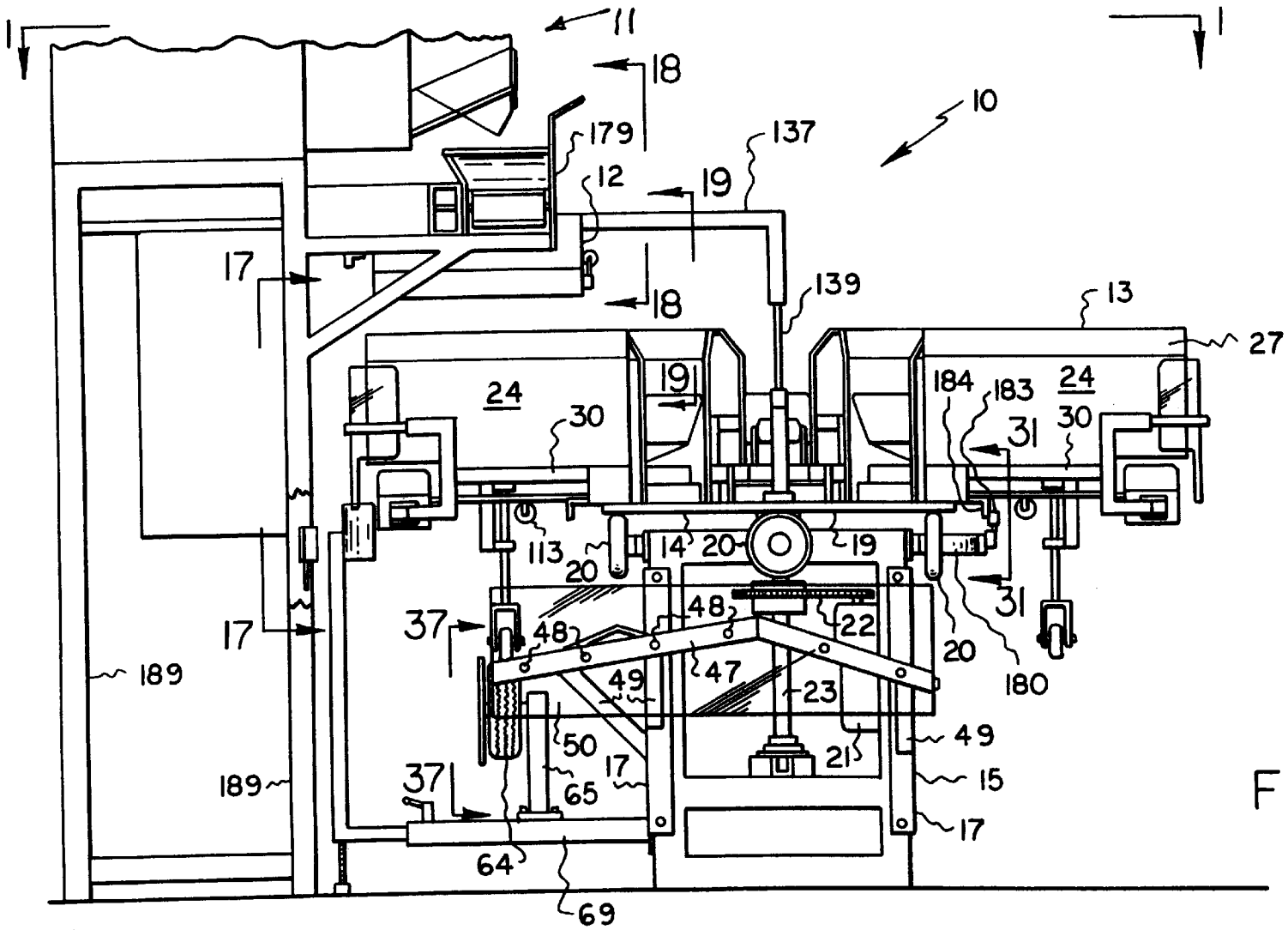
FIG. 2 is a side elevational view taken substantially in the direction of arrows 2—2 of FIG. 1 with certain parts omitted.
Figure 5:
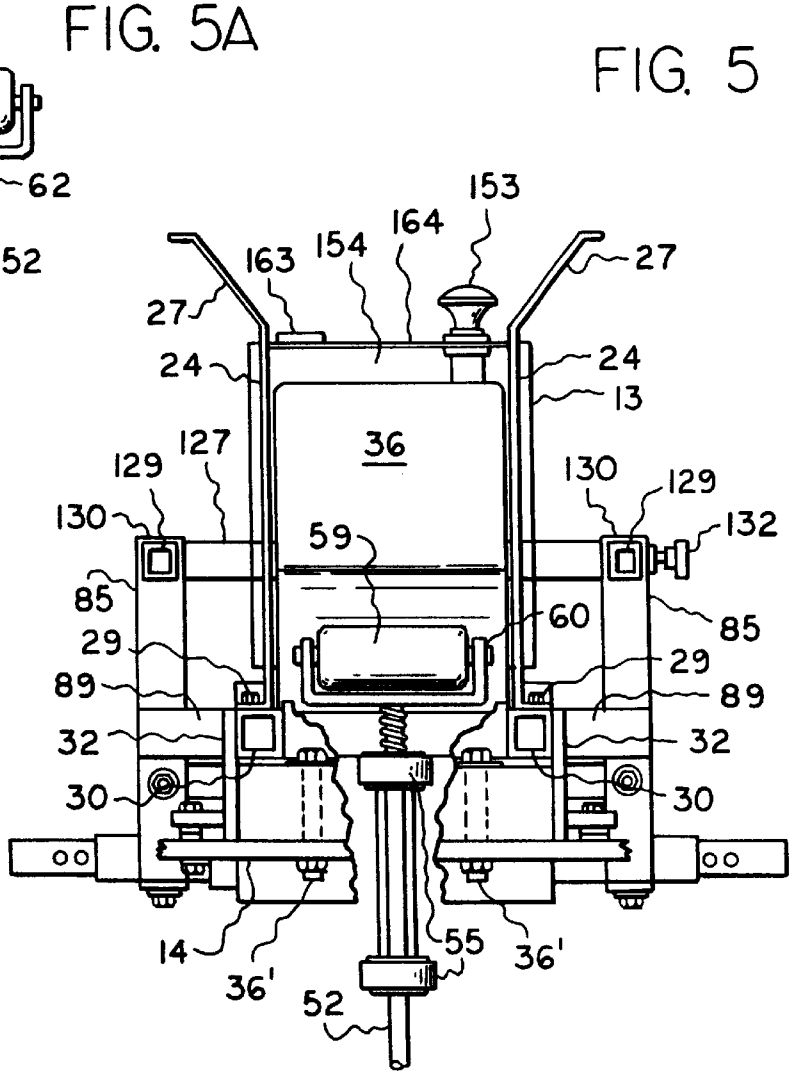
FIG. 5 is a partially broken away end elevational view of the trough showing the raising and lowering mechanism and taken substantially in the direction of arrows 5—5 of FIG. 3.
Figure 5A:
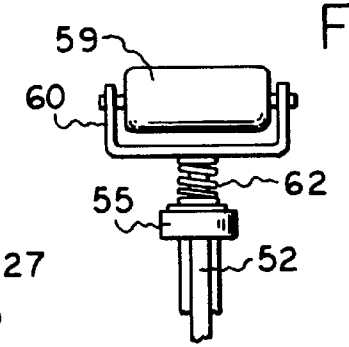
FIG. 5A is a fragmentary view of the roller mounting structure at the upper end of the trough raising and lowering mechanism.
Figure 21:
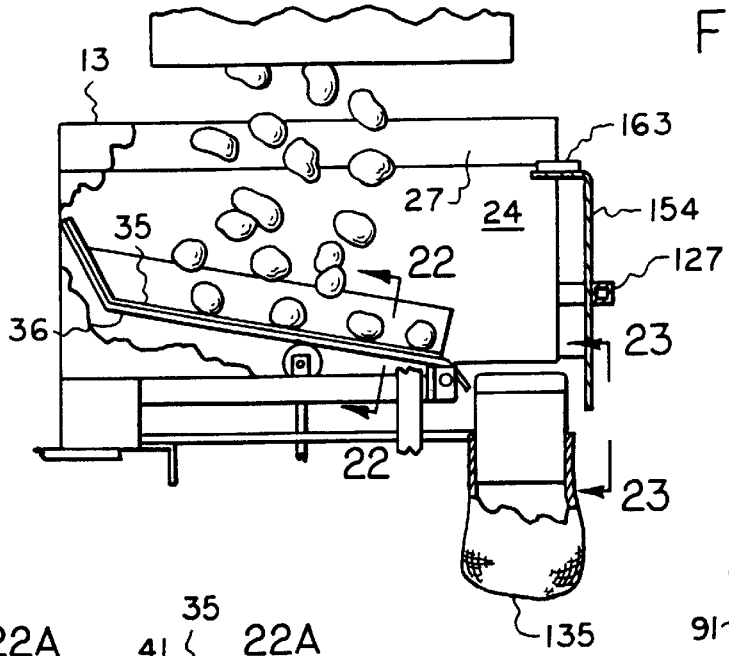
FIG. 21 is a fragmentary partially broken away view taken substantially in the direction of arrows 21—21 of FIG. 20.
Figure 22:
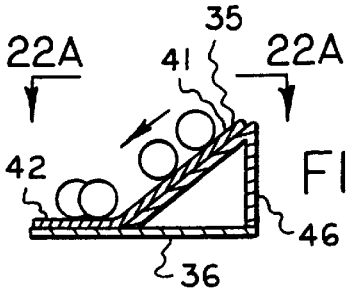
FIG. 22 is a fragmentary cross sectional view taken substantially along line 22—22 of FIG. 21 and showing produce on both portions of the bottom of the trough.
Figure 27:
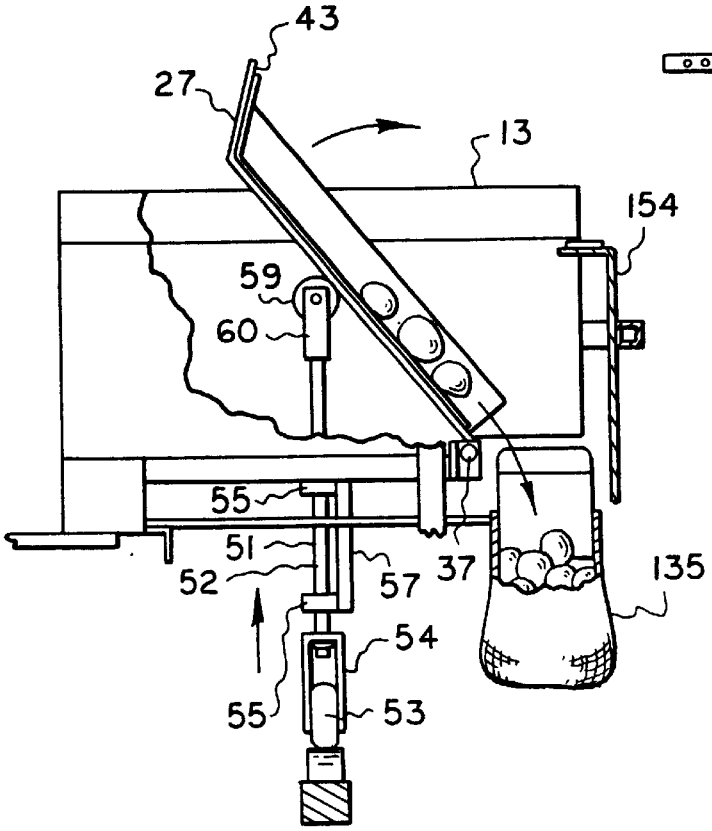
FIG. 27 is a partially broken away side elevational view taken substantially in the direction of arrows 27—27 of FIG. 26.
Figure 39:
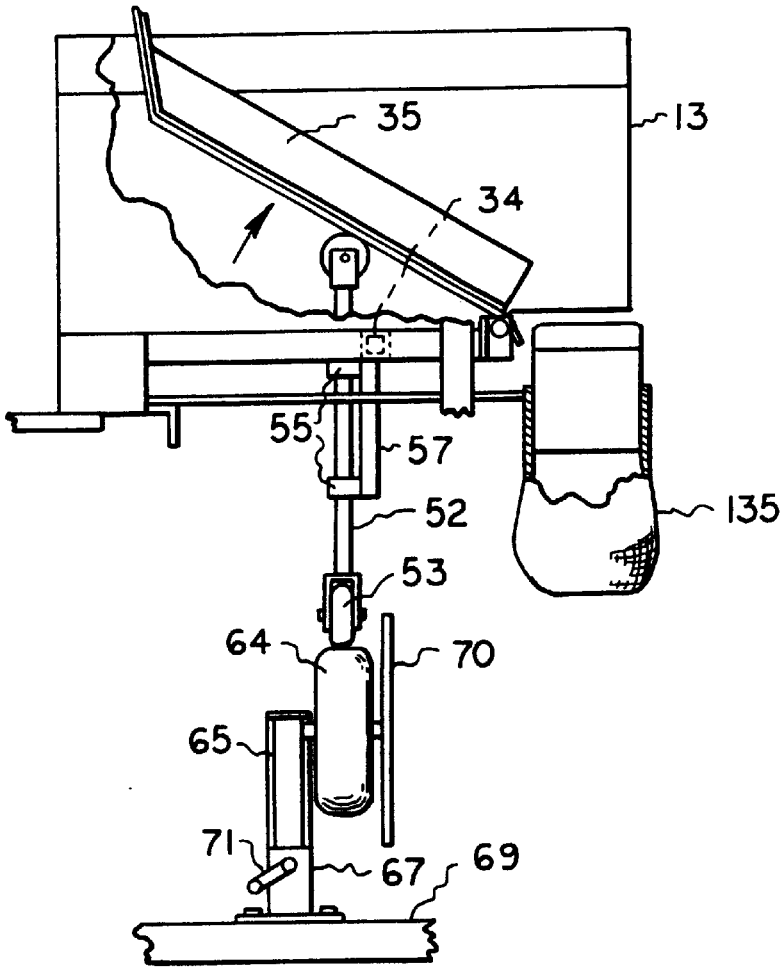
FIG. 39 is a view taken substantially in the direction of arrows 39—39 of FIG. 38.

Structure is provided for moving the bottom wall 35 between a lowermost position, such as shown in FIG. 21, to an uppermost position, such as shown in FIG. 27, so that produce which is dumped on the bottom wall 35 in the lowermost position of FIG. 21 can be routed into a bag as the produce travels downwardly as the bottom wall 35 moves to its uppermost position of FIG. 27 through the intermediate positions between those of FIGS. 21 and 27, as described hereafter. The fact that the bottom wall 35 can pivot relative to the fixed side walls 24 of the trough 13 results in loosening any product which may have bridges between the side walls. In this respect, a cam track 47 (FIGS. 1, 2, 24, 35A, 35B and 35C) is affixed to frame legs 17 by struts 49. A transparent shield 50 is affixed to cam track 47 by a plurality of bolts 48 (FIG. 1). A cam follower arrangement 51 follows cam track 47 as the table 14 rotates. There is a cam follower arrangement associated with each trough 13. The cam follower arrangement includes a shaft 52 (FIGS. 3, 4 and 5) having a roller 53 journaled in bracket 54 mounted at the lower end of shaft 52. Shaft 52 is guided for vertical movement in bearings 55 which are mounted in bracket 57 having its upper end welded to strut 34 (FIG. 3). A horizontally oriented elongated roller 59 (FIGS. 5, 5A, 19, 20, 25 and 27) is journaled in bracket 60 at the other upper end of shaft 51. A spring 62 is positioned between upper bearing 50 and bracket 60. Shaft 52 can rotate in bearings 55 so as to assume a square underlying relationship with planar plate 36 under bottom wall 35. As the trough raising and lowering structure follows the cam track during rotation of the table 14, the bottom wall 35 of the trough 13 will be raised and lowered. In this respect, as noted above, it receives the produce at a lowermost position 21 and raises the bottom wall 35 to the degree dictated by the contour of the cam track 47.

Figure 36A:
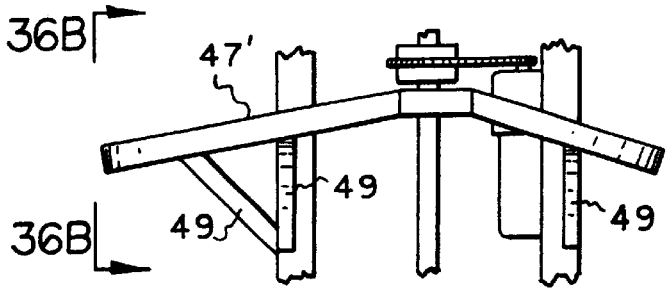
FIG. 36A is a fragmentary side elevational view of another form of cam track.
Figure 38:
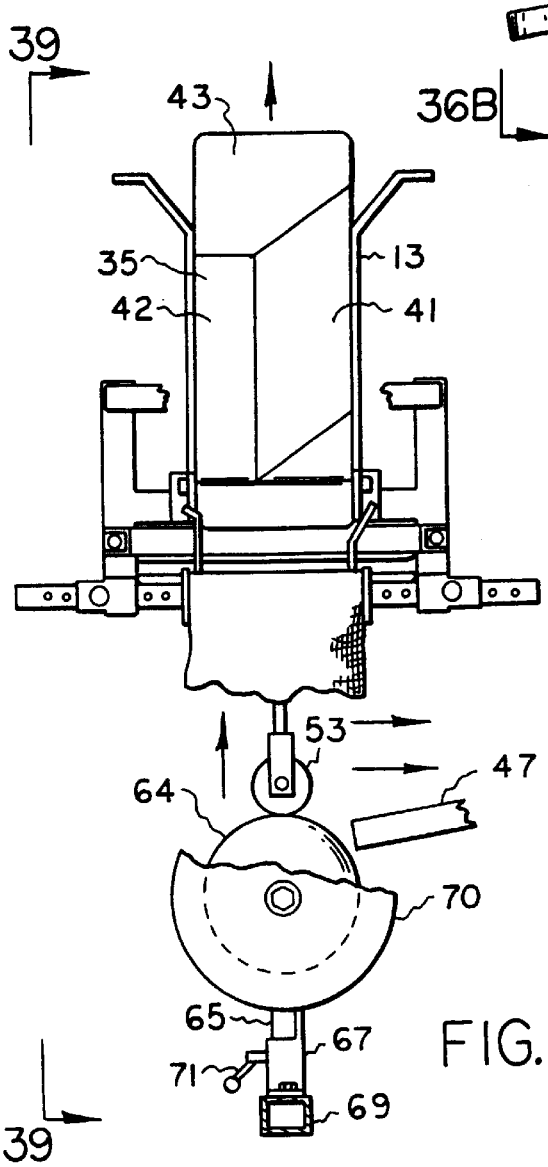
FIG. 38 is a fragmentary side elevational view showing a trough in relation to the wheel of FIG. 37.
Figure 37:
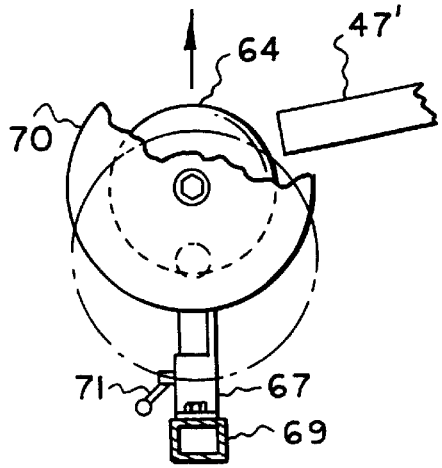
FIG. 37 is a fragmentary side elevational view of an adjustable wheel associated with the cam track for providing a jiggling action.

FIGS. 36A, 36B and 36C show a cam track 47' having a different contour as this may be desirable for different types of product. While not shown in the drawings, cam tracks, such as 47 and 47', may be selectively mountable and removable from struts 49 to thereby provide for optimum operation with different types of products. Also cam tracks can be contoured to meet the optimum trough-conveying characteristics of any specific product.

Figure 26:
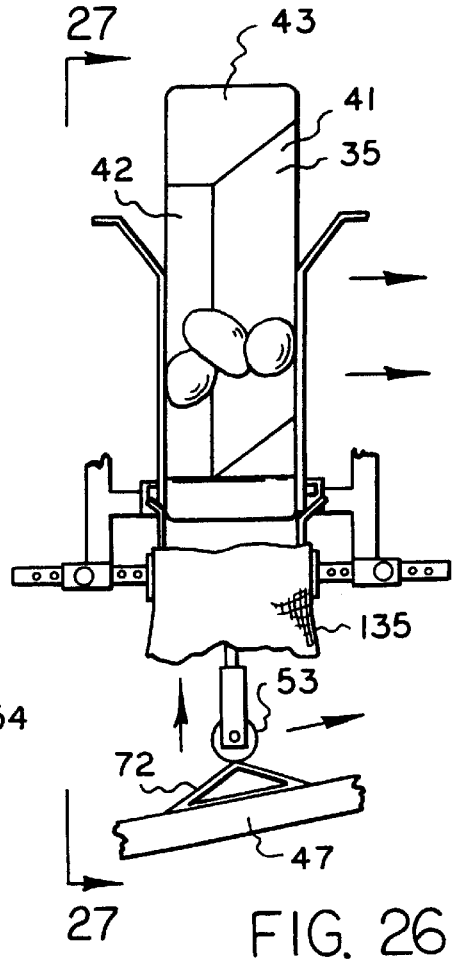
FIG. 26 is a fragmentary view similar to FIG. 24 but showing a bumping member mounted on the cam track to provide a jiggling action to the bottom wall of the trough.

There are additional structures which can be appended to the cam tracks in order to enhance the process of bagging the products. In this respect, a wheel 64 (FIGS. 2, 37, 38 and 39) is rotatably mounted on column 65 which is telescopically received in base 67 secured to frame member 69 which extends outwardly from frame 15. Wheel 64 is adjacent the entry portion of cam track 47. A circular shield 70 (FIGS. 38 and 39) may be mounted on the outer end of the shaft of wheel 64. A set screw arrangement 71 is utilized to lock column 65 at any desired height. As can be visualized from FIG. 38, the roller 35 rides over wheel 64 as the trough 13 moves to the right. The trough 13 is at or near a lowermost position when it receives the produce from the hopper 12. As the roller 53 traverses wheel 64, the bottom wall 35 will move up to effect a quick initial dumping of produce. Also, depending on the height of wheel 64, the roller 53 may experience a bump as it passes from wheel 64 onto cam track 47, thereby jarring the produce on bottom wall 35. Thereafter, the bottom wall 35 will rise gradually as roller 53 traverses the cam track to effect a more gradual dumping of the remaining produce from the trough. In FIG. 26 another arrangement is shown for providing a bump as the roller 53 traverses cam track 47. This bump-providing device is in the form of a triangular frame 72 which may be secured to cam track 47 by clamps or the like so as to provide a bump at any desired portion of the cam track, and a bump of this type would tend to jar loose produce which might otherwise tend to become jammed on bottom plate 35. It will be appreciated that the bump provider can take other configurations than triangular.

Figure 11:
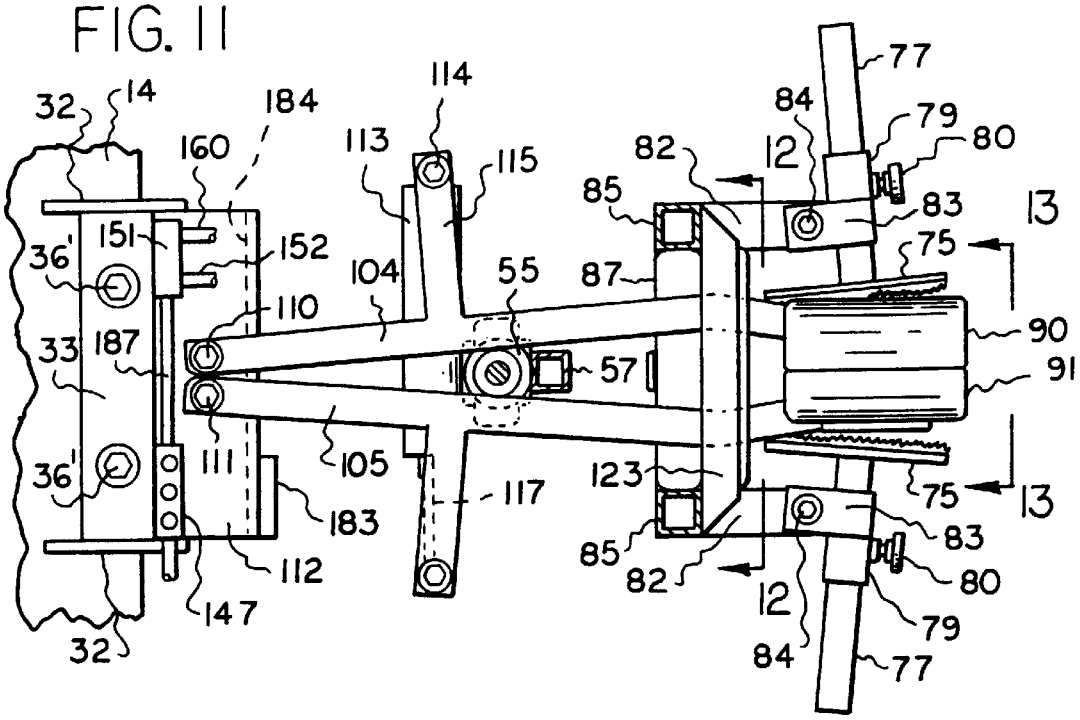
FIG. 11 is a fragmentary cross sectional view taken substantially along line 11—11 of FIG. 3 and showing the linkage for moving the combined movable pads and chutes.

A bag clamping and releasing structure is associated with each trough 13. This mechanism includes two adjustable stationary clamping pads 75 (FIGS. 4, 6, 7, 11, 13 and 16) which are mounted on rods 77 having apertures 81 and which are slidably mounted in tubular members 79 and retained in an adjusted position by set screws 80 which enter apertures 81. Tubular members 79 are pivotally mounted on frame members 82 by brackets 83 (FIGS. 7 and 11) which are secured to member 82 by bolts 84. As can be visualized from FIGS. 6 and 7, the distance between pads 75 and the orientation of each pad 75 can be adjusted by moving tubular members 77 in and out of tubular members 79 and by pivoting brackets 83 about the axes of bolts 84 and thereafter tightening bolts 84. Frame members 82 are welded to the bottom of members 85 (FIG. 3). The opposite ends of tubular member 87 (FIG. 11) are welded to the lower ends of tubular members 85 (FIG. 3) at the ends of tubular members 82 (FIGS. 3 and 11). The central portions of members 85 are connected to tubular members 30 (FIG. 5) by horizontal tubular members 89.

Figure 15:
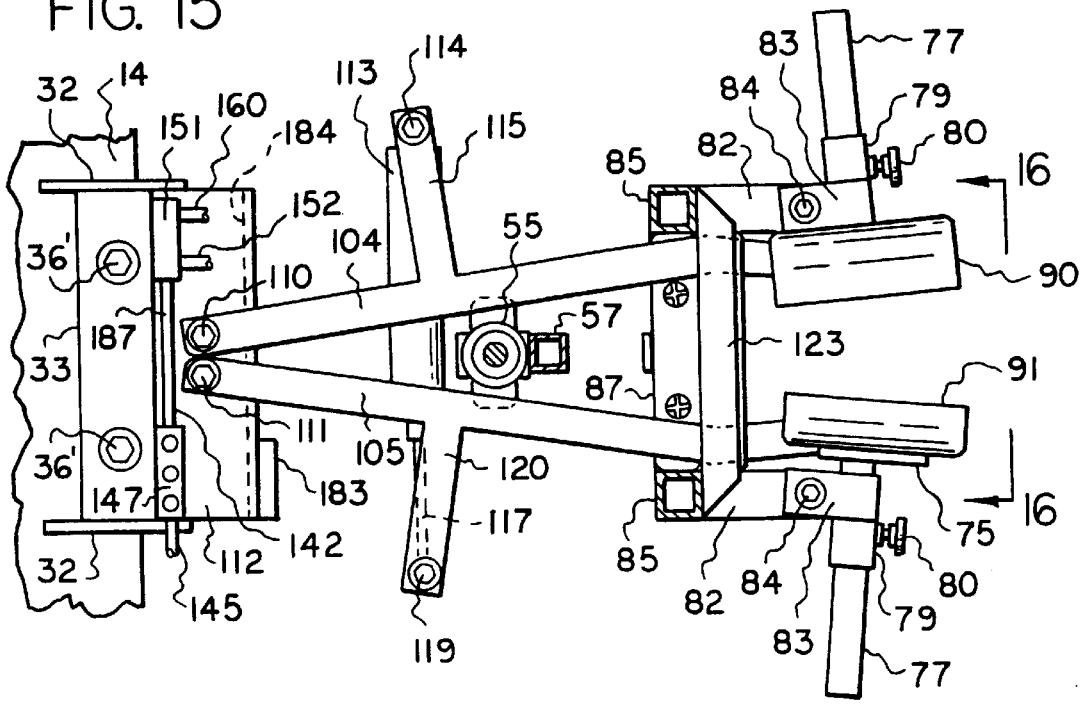
FIG. 15 is a fragmentary cross sectional view similar to FIG. 11 but showing the bag clamping pads in position for clamping the opposite sides of a bag.
Figure 12:
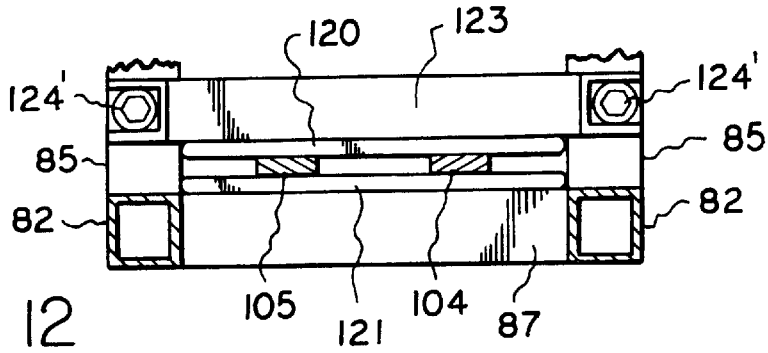
FIG. 12 is a fragmentary cross sectional view taken substantially along line 12—12 of FIG. 11 and showing the support structure for the movable linkage which mounts the combined chute and pads.
Figure 13:
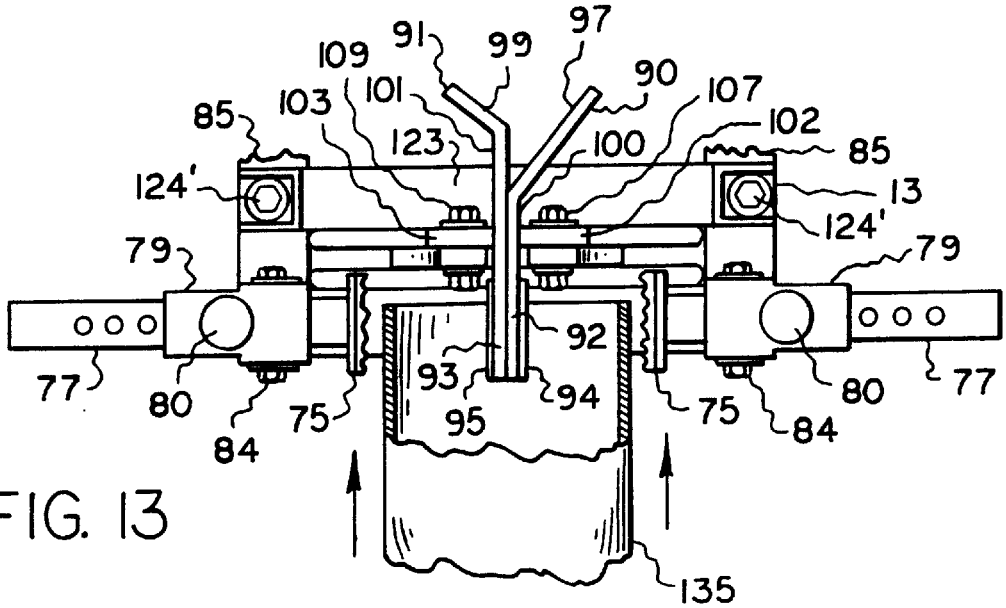
FIG. 13 is a fragmentary end elevational view taken substantially in the direction of arrows 13—13 of FIG. 11 and showing a partially broken away bag in position prior to being clamped.

The bag clamping and releasing structure also includes movable combined chute and bag-clamping members 90 and 91 (FIGS. 3, 4, 8, 9, 11, 13 and 15). Combined chute and bag-clamping members 90 and 91 (FIG. 13) include vertical sides 92 and 93, respectively, mounting on their outer sides pads 94 and 95, respectively. The upper portions of sides 92 and 93 are unevenly inclined as shown at 97 and 99, respectively. The movable combined chute and bag-clamping members 90 and 91 are mounted on the frame of the bagger 10 in the following manner (FIGS. 4, 8, 9, 11, 12, 13 and 15). The outer sides 100 and 101 (FIG. 13) of members 90 and 91, respectively, have plates 102 and 103 welded thereto (FIGS. 8, 9 and 13). Plates 102 and 103 are pivotally mounted on the outer ends of links 104 and 105, respectively, by bolts 107 and 109, respectively (FIGS. 8 and 9). Thus, the outer sides of clamping members 90 and 91 can be adjusted to be parallel to fixed clamps 75, as required. The inner ends of links 104 and 105 are pivotally mounted at 110 and 111 (FIGS. 11 and 15), respectively, on plate 112 which is welded to and extends between plates 32 (FIGS. 3 and 11). A pneumatic cylinder 113 (FIGS. 3, 11 and 15) has its end pivotally mounted at 114 on arm 115 which is welded to link 104. The piston rod 117 of cylinder 113 has its outer end pivotally mounted at 119 on the outer end of member 120 which is welded to and extends outwardly from link 105. As will become apparent hereafter, cylinder 113 is pneumatically actuated between two positions, namely, the position of FIG. 11 wherein the combined chute and clamping members 90, 91 are together (FIGS. 11 and 13) and the position wherein they are apart and in engagement with stationary clamping members 75 (FIG. 15). During the movement of links 104 and 105 between the positions of FIGS. 11 and 15, they are guided between plastic strips 120 and 121 (FIG. 12) which are mounted on tubular members 87 and 123, respectively. Tubular member 87 has its opposite ends welded to the lowermost portions of tubular members 85 (FIGS. 3 and 12) and tubular member 123 is bolted at 124 to members 85.

Figure 4:
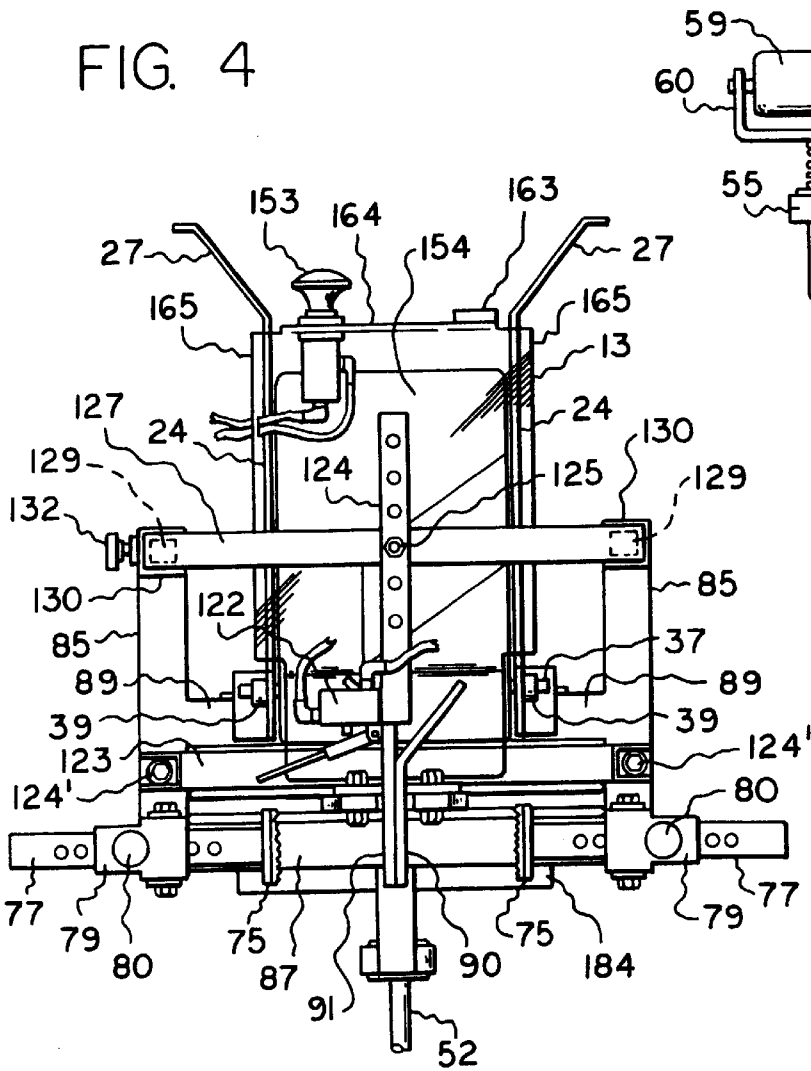
FIG. 4 is an end elevational view of the trough and related structure taken substantially in the direction of arrows 4—4 of FIG. 3.
Figure 14:
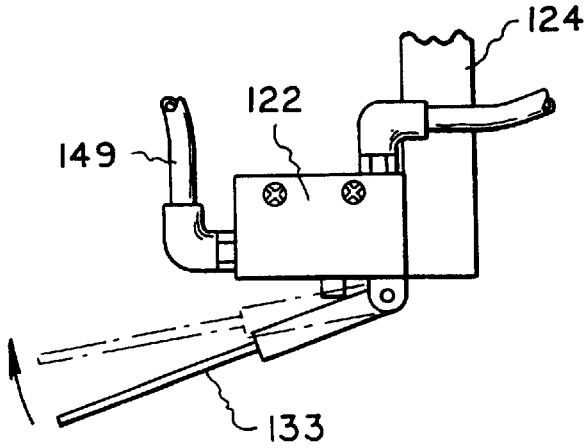
FIG. 14 is a fragmentary enlarged view taken substantially in the direction of arrows 14—14 of FIG. 10 and showing the clamp actuating valve structure including its actuating lever.
Figure 16:
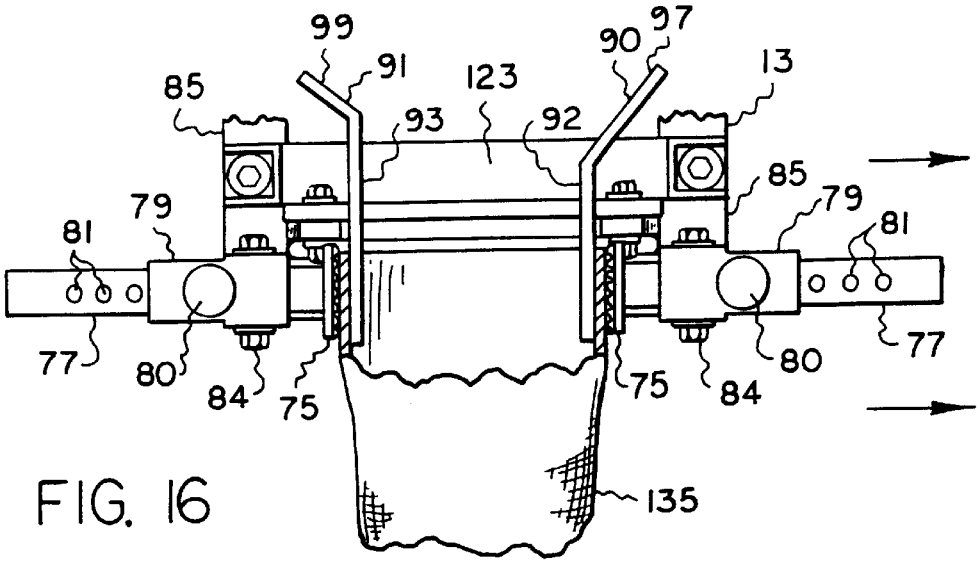
FIG. 16 is a fragmentary end elevational view taken substantially in the direction of arrows 16—16 of FIG. 15 and showing a partially broken away bag clamped between the clamping pads.

The movement of the combined chute and clamping members 90, 91 from the closed position of FIG. 11 to the open position of FIG. 15 is controlled by a pneumatic switch 122 (FIGS. 3, 4, 14 and 40) which is mounted on perforated metal strip 124 which is pivotally mounted at 125 on cross member 127 (FIG. 4) which has its opposite ends welded to tubular members 129 which are telescopically received in tubular members 130 which are welded to the upper ends of tubular members 85 (FIGS. 3 and 4). One tubular member 129 has apertures 131 therein and members 129 can be moved to different positions relative to tubular members 130 and retained therein by set screw 132 which exists only on one of the tubular members 130 and is received in a selected aperture. As can be seen from FIG. 10, the position of strip 124 and pneumatic switch 122 thereon can be adjusted toward and away from the trough 13, and the angle of strip 124 can be adjusted to any desired position so as to place the lever 133 (FIG. 14) associated with switch 122 at any convenient location for access by the person loading the bags.

The above-described clamping structure exclusive of the combined chute and clamping members 90, 91 is not novel.

The bags are loaded onto each trough 13 in the following manner. A person is located at a position where the bag-loading mechanism, namely, the combined chute and clamp members 90 and 91 are in the orientations of FIGS. 4 and 11, that is, together. This position can be anywhere after a preceding filled bag has been unloaded, namely, anywhere between the three o'clock and twelve o'clock positions of FIG. 1. The operator takes an open bag and slips it up around the closed combined chute and clamp members 90 and 91 (FIG. 13) such that the upper edges of the bag 135 lie between the stationary pads 75 and the movable pads 94 and 95 on combined clamp and chute members 90 and 91, respectively. The operator then pulls the bag forwardly toward him, that is, to the right in FIG. 3. He then trips lever 133 on valve 122 from the solid to the dotted line position in FIG. 14 which will then admit air to cylinder 113 (FIG. 11) so that the cylinder will push piston rod 117 outwardly to cause the links 104 and 105 to pivot from the position of FIG. 11 to the position of FIG. 15, thereby moving combined chute and clamp members 90 and 91 outwardly to the position of FIG. 15 and into engagement with stationary clamps 75 to thereby clamp the other upper edges of bag 135 therebetween. This is all done while the carousel is rotating.

Figure 40:
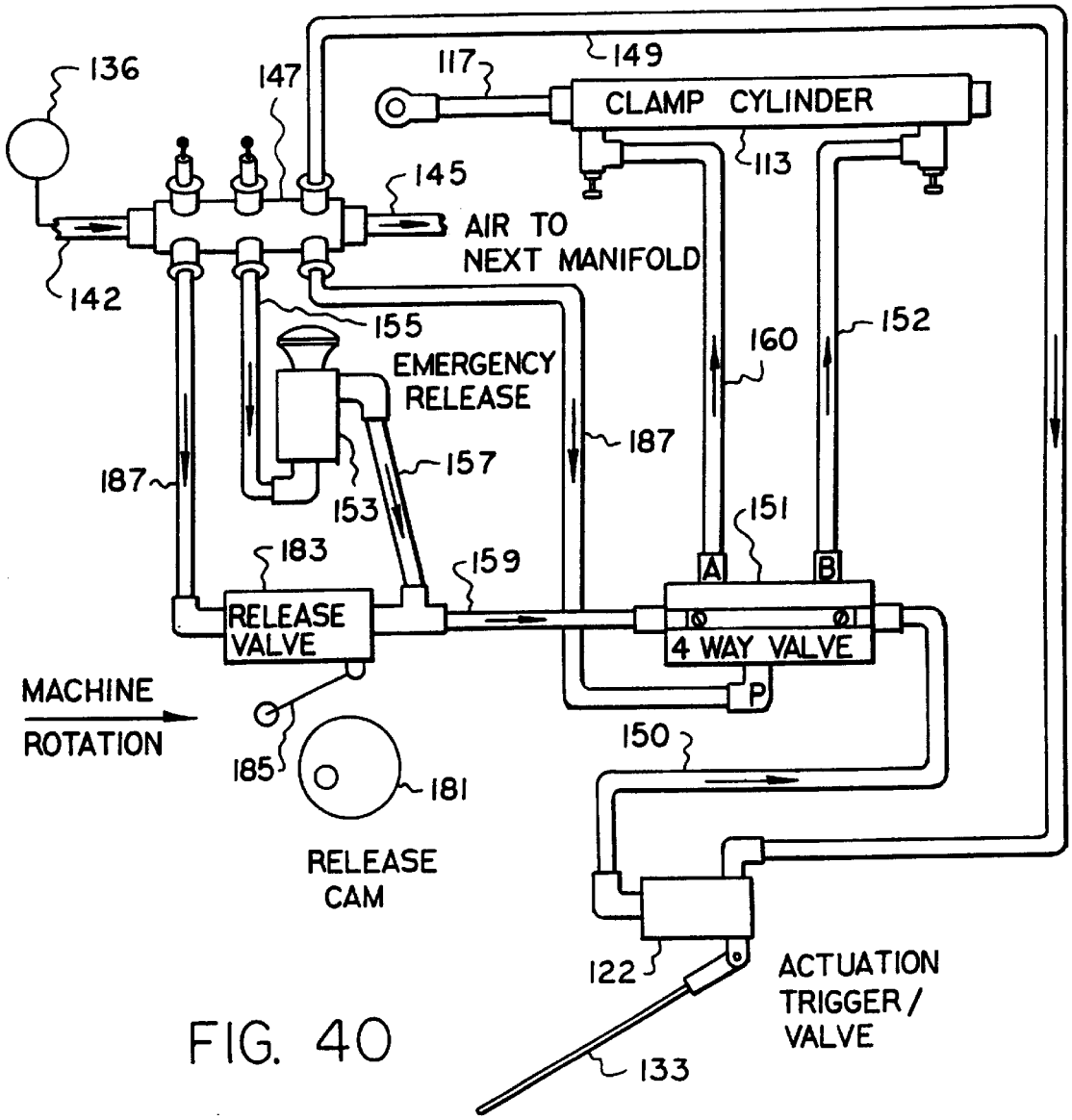
FIG. 40 is a schematic view of the compressed air system for actuating the various pneumatic devices.
Figure 41:
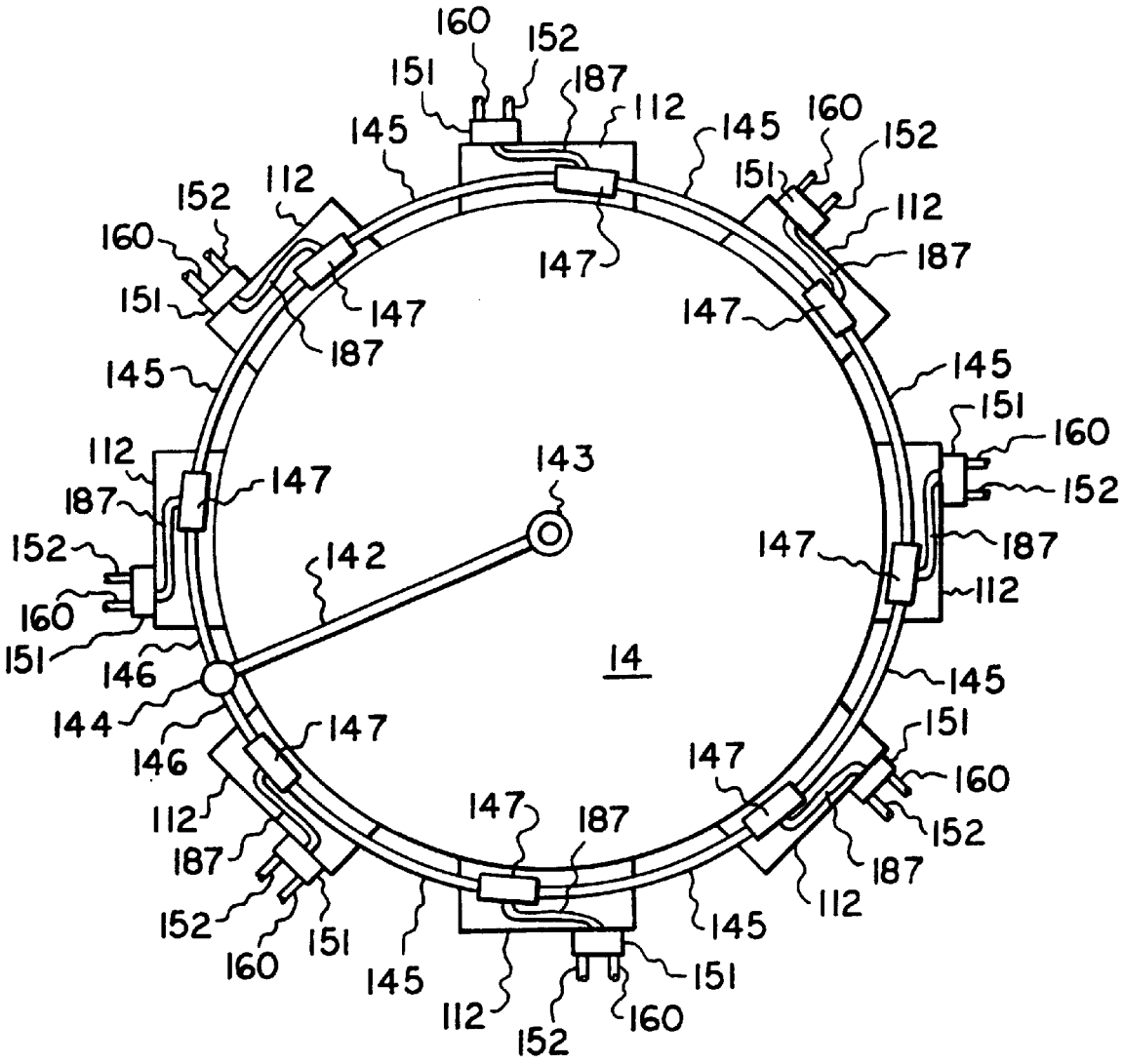
FIG. 41 is a schematic view showing a portion of the pneumatic system.

At this point it is to be noted that compressed air is supplied to valve 122 in the following manner. There is a compressed air source 136 (FIG. 40) external of the carousel bagger 10. A conduit 137 (FIG. 2) has one end immovably secured to the weigher 11, and it is in communication with the external source of compressed air. The compressed air passes through conduit 137 into conduit 139 (FIGS. 2 and 2A) and through a fluid tight rotary coupling 140 which is mounted between stationary conduit 139 and conduit 141 mounted on column 143 for rotation with table 14. Conduit 141 is in communication with a conduit 142 (FIGS. 3 and 41) leading to pressure regulator 144 (FIG. 41) mounted on the side of table 14. Conduits 146 extend between pressure regulator 144 and manifolds 147 (FIG. 41) mounted on plates 112 (FIGS. 11 and 15) on each trough 13 adjacent to pressure regulator 144. Conduits 145 extend between other of the manifolds 147 themselves (FIG. 41). A conduit 149 (FIG. 40) leads from each manifold 147 to an associated valve 122 on each trough, and when valve 122 is actuated by movement of lever 133, communication is established to conduit 150 which actuates four-way valve 151 to effect communication between conduit 150 and conduit 152 to extend piston rod 117 from cylinder 113 to thereby move links 104 and 105 to the position of FIG. 15. As noted above, this will cause the upper edges of the bag 135 to be clamped between the movable clamp pad portions 94 and 95 of combined chute and clamp members 90 and 91, respectively, and fixed clamps 75. If for any reason it is desired to move the combined chute and clamping members 90 and 91 back to their position of FIGS. 4 and 11, that is, away from fixed clamps 75, there is an emergency release valve 153 mounted on transparent shield 154 which is secured by a bolt (not shown) to tubular member 127 (FIG. 3). The actuation of emergency release valve 153 will permit compressed air to flow from manifold 147 and conduit 155 into conduits 157 and 159 to thereby actuate four-way valve 151 to permit communication to conduit 160, thereby actuating clamp cylinder 113 to move its piston rod 117 inwardly, thereby causing the links 104 and 105 to return to the position of FIG. 11 wherein the bag 135 is unclamped.

Figure 17:
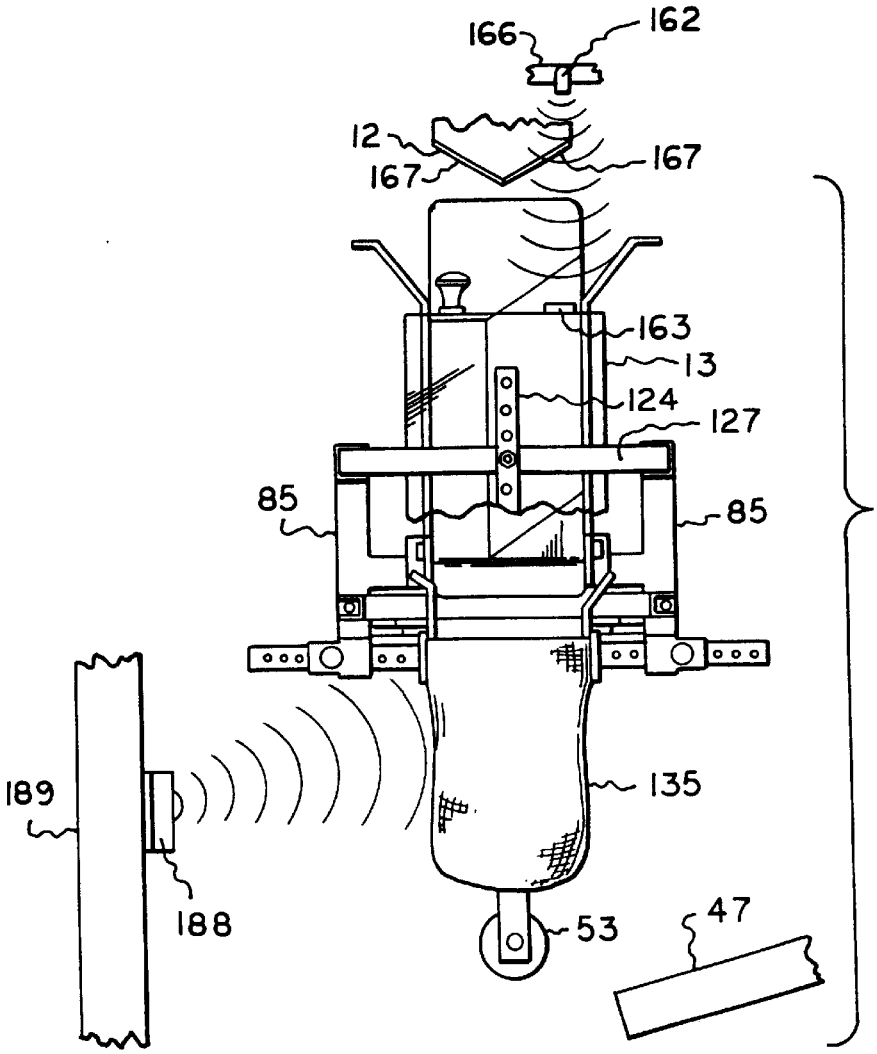
FIG. 17 is an end elevational view taken substantially in the direction of arrows 17—17 of FIG. 2 and showing a bag in clamped position and the electric eye structure for determining whether a bag has been loaded and the electric eye structure for opening the hopper which dumps produce into the trough.
Figure 19:
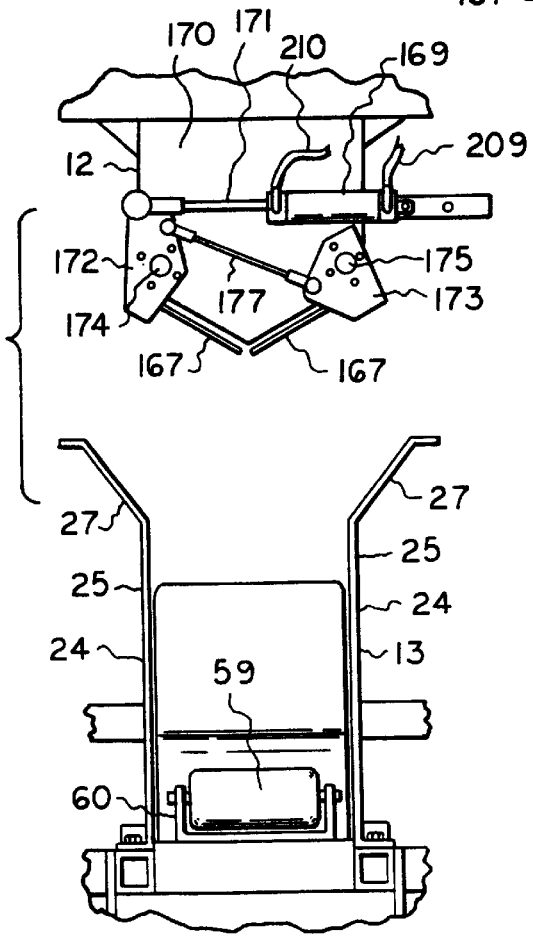
FIG. 19 is a fragmentary end elevational view taken substantially in the direction of arrows 19—19 of FIG. 2 and showing the relationship between the hopper and the trough with the bottom wall of the trough being in its lowest position.
Figure 20:
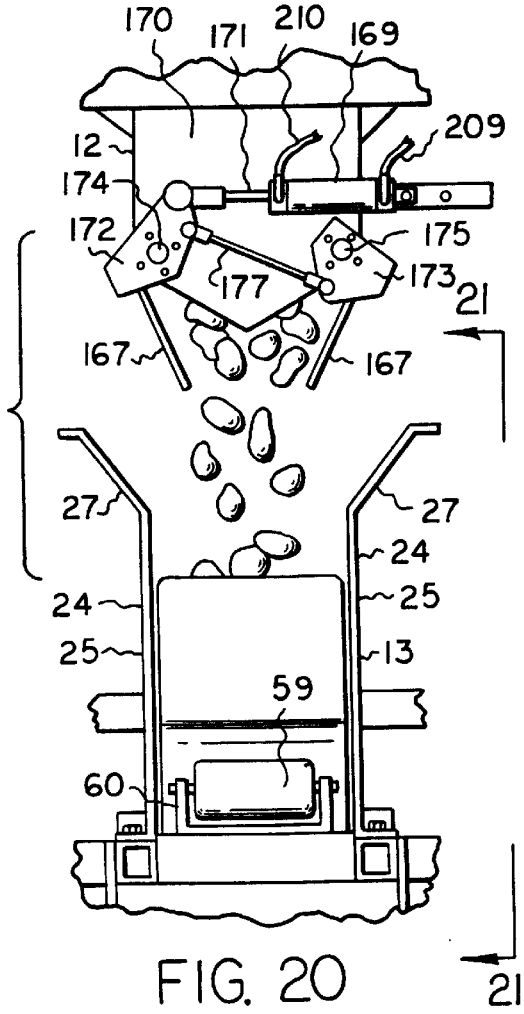
FIG. 20 is a view similar to FIG. 19 but showing produce being dumped into the chute when the bottom wall of the trough is in its lowermost position.

The bag 135 which has been clamped in the above-described manner travels counterclockwise (FIG. 1) with its associated trough 13 until it reaches a point underneath full hopper 12 (FIGS. 2 and 17) wherein an electric eye 162 on the frame portion 166 (FIG. 17) of the weigher is actuated by reflector 163 (FIGS. 3, 4 and 5) mounted on transparent plate 164 which extends rearwardly from transparent plate 154 and lies between transparent side plates 165. This will cause the hopper doors 167 to move to their open position (FIG. 20) from their closed position (FIG. 19). In this respect, a pneumatic cylinder 169 is suitably mounted on the front wall 170 of hopper 12. When cylinder 169 is actuated, it will pull its piston rod 171 inwardly from the position of FIG. 19 to the position of FIG. 20. This will cause plates 172 and 173 to pivot about their pivots 174 and 175, respectively, on wall 170. The doors 167 are secured to plates 172 and 173, and the plates 172 and 173 are connected by a link 177. When the doors 167 are moved to the position of FIG. 20, the produce will be dumped into trough 13. At this point it is to be noted that mirror image counterparts of plates 172 and 173 are mounted on the rear wall 179 of the hopper. After the produce has been dumped, cylinder 169 will be actuated to move back to its position of FIG. 19 to thereby return the doors 167 to their closed position.

After each trough 13 has been loaded, the carousel will continue its travel and a point will be reached where the roller 53 reaches cam track 47 as described above and the produce which has entered the trough 13 in its lowermost position of FIG. 21 will be progressively raised and possibly jarred, as described above until it reaches its maximum inclined position of FIG. 27 whereby the produce is completely dumped into bag 135. After the roller 53 leaves cam track 47, the bottom wall 35 of the trough will pivot back to its lowermost position of FIG. 21 by gravity.

Figure 31A:
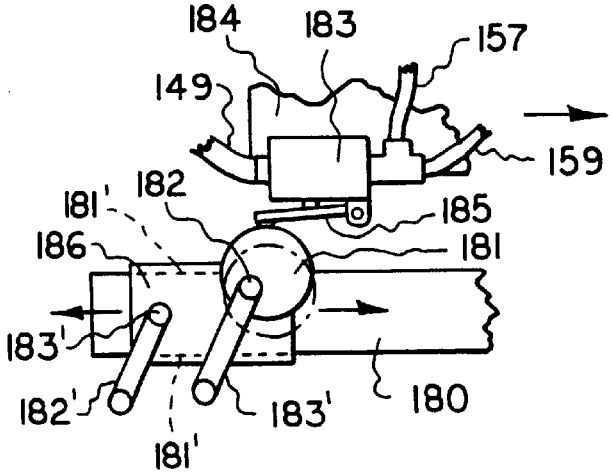
FIG. 31A is a fragmentary enlarged portion of FIG. 31.

Structure is provided for automatically releasing bag 135 after it leaves cam track 47. In this respect, a rail 180 (FIGS. 31 and 31A) is suitably attached to frame 15 and it mounts an eccentric wheel 181 on a plate 186 which is slidable on rail 180 because it has bent over edges 181' which wrap around the edges of rail 180. A set screw 183' having a handle 182' attached thereto is used to hold plate 186 in any desired adjusted position on rail 180. Wheel 181 can be pivoted about pivot 182 so that it will extend different distances above rail 180. A set screw is associated with handle 183' to lock wheel 181 into an adjusted position on plate 186. A valve 183 is mounted on a plate 184 which extends downwardly from plate 112 (FIGS. 3, 11 and 15). When the arm 185 (FIGS. 31A and 40) of valve 183 is actuated by passing over wheel 181, valve 183 will open to thereby conduct compressed air from manifold 147 (FIG. 40) through duct 187 and duct 159 to shift four-way valve 151 to thereby permit compressed air to flow through duct 160 to clamp cylinder 113 to thereby draw piston rod 117 into clamp cylinder 131 to thereby move links 104 and 105 from their outward position of FIG. 15 to their inward position of FIG. 11 to unclamp bag 135.

An arrangement is shown for preventing hopper 162 from dumping its produce into the trough 13 passing underneath if there is no bag clamped in position on the trough 13. In this respect, an electric eye 188 (FIGS. 1 and 17) is mounted on a leg 189 of weigher 11. If electric eye 187 does not detect a bag on the trough 13 passing by, the cylinder 169 will not be actuated in the above-described manner to open hopper doors 167.

Figure 42:
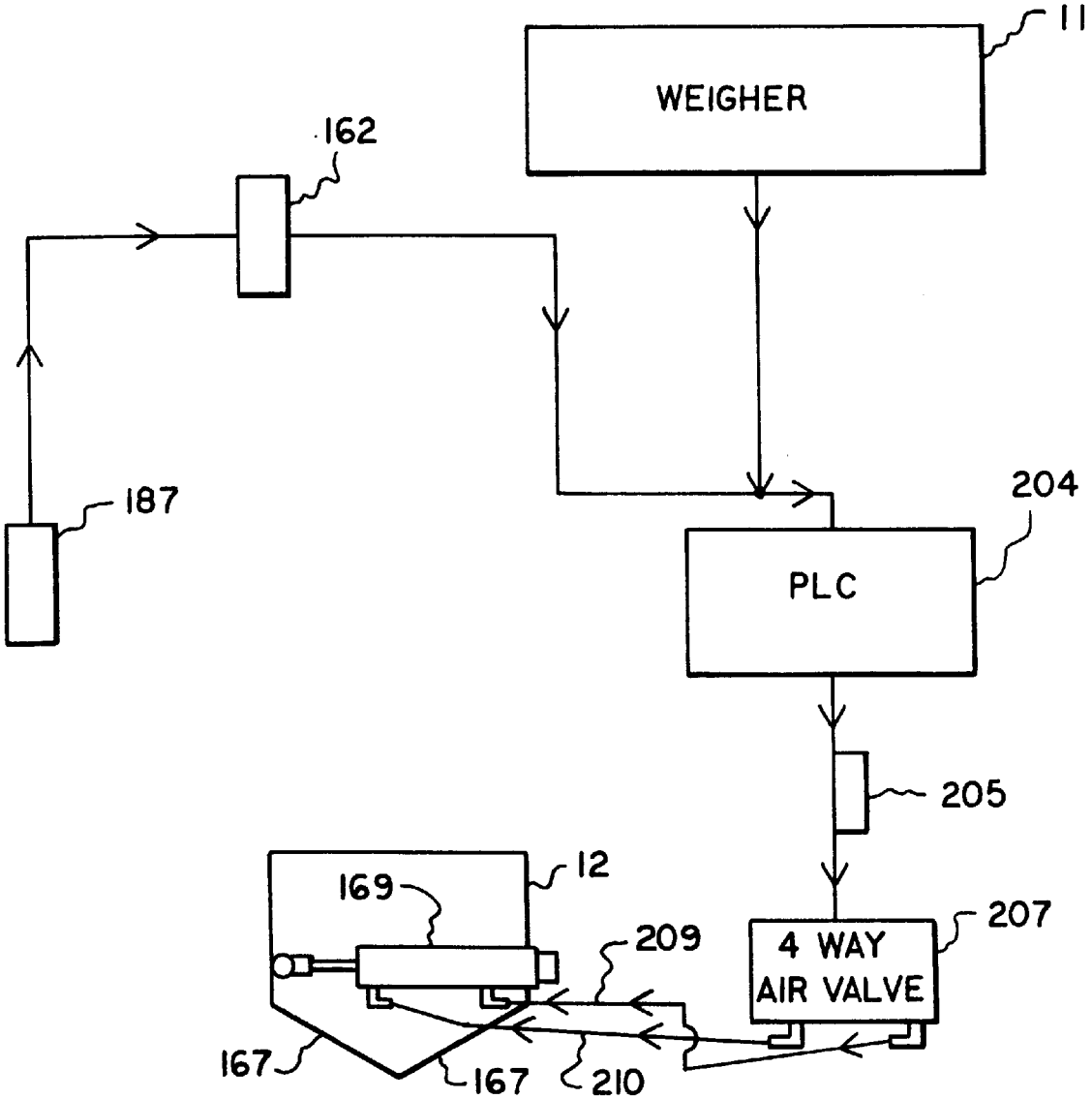
FIG. 42 is a schematic diagram showing the circuit for opening the hopper only when the hopper is full and a bag is hung on the trough and the trough is directly under the hopper.

For product to be dumped from hopper 12 into a trough 13 a plurality of conditions have to be met. As noted above, the electric eye 187 must detect that a bag 135 has been hung on the trough 13. Also, electric eye 162 must detect that the trough 13 is underneath hopper 12. Also, there is an electrical input (FIG. 42) from weigher 11 to the PLC to indicate that product has been dumped into hopper 12. After all of the foregoing conditions have been met, the hopper doors 167 can open to dump product into trough 13. The foregoing is schematically represented in FIG. 42. The output of electric eye 187 is in series with the output of electric eye 162, and their combined output is conducted to PLC 204. Also, there is an output from weigher 11 conducted to PLC 204 after the weigher has dumped product into hopper 12. When the three outputs are received by the PLC, a relay 205 will be actuated to shift a four-way pneumatic valve 207 to a position wherein it supplies compressed air cylinder 169 to open hopper doors 167 in the above described manner to dump product into trough 13. After the dumping has been effected, the PLC will deenergize relay 205 so that the four-way valve will be actuated to supply compressed air to cylinder 169 to cause doors 167 to close so that the hopper 12 is in condition to receive another load of product. The cylinder 169 is actuated through conduits 209 and 210 which lead from four-way valve 207. The four-way valve 207 is in addition to four-way valve 151 (FIG. 40), and it is mounted on the frame of weigher 11, as is the PLC 204 and associated circuitry. Also, the source of compressed air for four-way valve 207 is 136 (FIG. 40). All of the foregoing in this paragraph is known in the art.

As can be seen from FIG. 33, the produce falls on both the inclined section 41 and the relatively horizontal section 42 (FIGS. 22 and 22A) of bottom wall 35. Thus, the produce, such as potatoes 191, on section 42 will tend to move directly downwardly as the bottom wall 35 tilts. The produce, such as potatoes 190, falling on inclined section 41 not only will move downwardly but it will also move relatively sidewise. Therefore, the produce will tend to move down bottom wall 35 in more of a single file than if the bottom wall 35 were flat.

Figure 23:
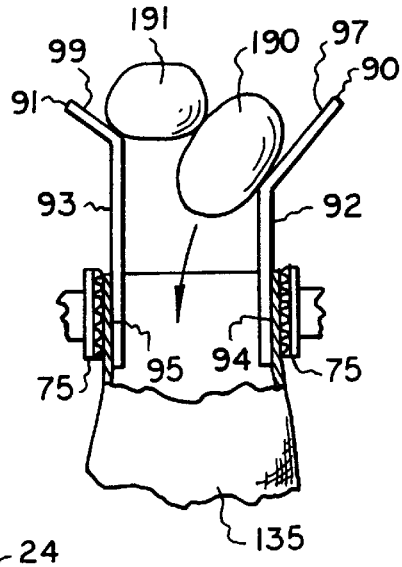
FIG. 23 is a fragmentary end elevational view showing the produce which is conducted by the chute at the end of the trough leading to the clamped bag.
Figure 22A:
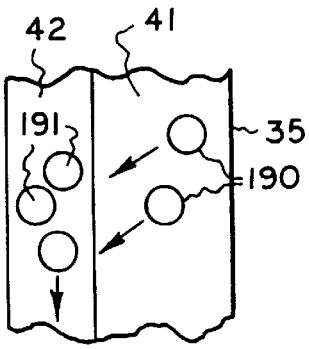
FIG. 22A is a view taken substantially in the direction of arrows 22A—22A of FIG. 22 and showing schematically the path of produce on the two sections of the bottom of the trough.
Figure 24:
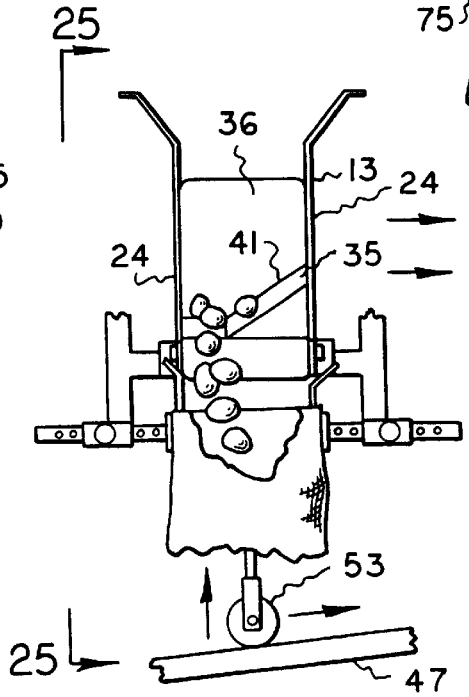
FIG. 24 is a view showing produce being dumped into the clamped bag as the bottom of the trough is being lifted by linkage which runs along the cam track.
Figure 25:
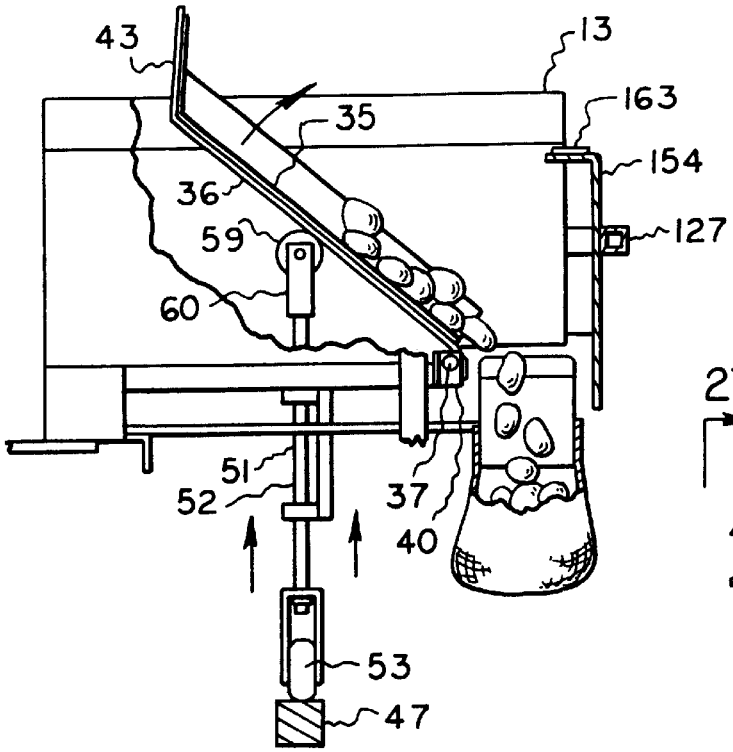
FIG. 25 is a partially broken away side elevational view taken substantially in the direction of arrows 25—25 of FIG. 24.

In addition to the foregoing, it is to be noted from FIG. 23 that portion 97 of combined chute and clamp 90 is inclined a different angle than portion 99 of combined chute and clamp 91. Thus, an item of produce, such as potato 190, which hits portion 97 will move differently than potato 191 which hits portion 99. This also tends to prevent the potatoes from jamming up before they pass between sides 92 and 93 which constitute the chute portions of combined chute and clamp pad members 90 and 91. In addition to the foregoing, the transparent shield 154 (FIGS. 3 and 4) confines the produce to a path between the chute sides 92 and 93. Also the transparent sides 165 secured to shield 154 prevent the items coming off of bottom wall 135 from missing chute sides 92–93 when shield 154 is extended away from trough walls 24.

In addition to the foregoing, the bottom wall 35 of trough 13 can be modified by clipping a modifier plate 193 (FIGS.

32 and 33A) onto bottom wall 35. In this respect, modifier plate 193 includes a bottom section 194 which fits onto relatively horizontal flat section 42. It also includes an inclined modifying section 195 which thus changes the angle of the bottom wall relative to section 41 relative to the original section 42. The changed angle is also an obtuse angle but it is less than the original angles. However, in certain instances, the changed angle can be a right angle or even an acute angle. The modifying bottom wall portion 193 has a rear wall 197 which fits along said rear wall 43 and clips onto it by the overhanging clip portion 199'. The modifier plate 193 creates a vertex 199 between inclined bottom wall section 41 and section 195 to thereby tend to cause the product such as nuts 200 to move downwardly in single file. This is achieved because each item falling on sections 41 and 195 moves downwardly at an angle, and since sections 41 and 195 are inclined at different angles, they move downwardly toward vertex 200 at different rates, thereby tending to move into a single file.

In FIG. 34 an adjustment is shown for varying the length of legs 17 of the carousel frame 15. This structure includes a tubular portion 200 which telescopes into each leg 17 and is retained in position by set screws 201.

While preferred embodiments of the present invention have been disclosed, it will be appreciated that it is not limited thereto but may be otherwise embodied within the scope of the following claims.

What is claimed is:

1. A carousel bagger comprising a frame, a rotatable table mounted on said frame, a plurality of troughs mounted on said table for rotation therewith, side walls on said troughs fixedly mounted on said table, inner and outer ends on said troughs, a bottom wall in each of said troughs, a pivotal mounting securing each of said bottom walls relative to said side walls proximate said outer ends of each of said troughs, a cam track, and a linkage between said cam track and each of said bottom walls for pivoting said bottom walls about said pivotal mounting.

2. A carousel bagger as set forth in claim 1 wherein said linkage includes a cam follower mounted on said table for each of said troughs, and a connection between each of said cam followers and said bottom walls.

3. A carousel bagger as set forth in claim 2 wherein each of said cam followers comprises an elongated rod, a first roller mounted at one end of said elongated rod for engaging said cam track, and wherein said connection comprises a second roller mounted at the other end of said elongated rod for engaging said bottom wall.

4. A carousel bagger as set forth in claim 3 including bag-clamping members mounted on said table proximate each of said outer ends of said troughs.

5. A carousel bagger as set forth in claim 4 wherein said bag-clamping members include spaced first and second outer bag-clamping members, and movable first and second inner combined chute and bag-clamping members located within said first and second outer bag-clamping members, and first and second opposed chute sides on said first and second inner combined chute and bag-clamping members, respectively.

6. A carousel bagger as set forth in claim 5 wherein at least one of said first and second opposed chute sides includes a lower portion which is substantially vertical, and an upper portion which extends outwardly from said lower portion.

7. A carousel bagger as set forth in claim 5 wherein said first and second opposed chute sides include lower portions which are substantially vertical and upper portions which extend outwardly from said lower portions.

8. A carousel bagger as set forth in claim 7 wherein said upper portions are located at different levels.

9. A carousel bagger as set forth in claim 8 wherein said upper portions extend outwardly from said substantially vertical portions at different angles.

10. A carousel bagger as set forth in claim 7 wherein said upper portions extend outwardly from said substantially vertical portions at different angles.

11. A carousel bagger as set forth in claim 2 including bag-clamping members mounted on said table proximate each of said outer ends of said troughs.

12. A carousel bagger as set forth in claim 11 wherein said bag-clamping members include spaced first and second outer bag-clamping members, and movable first and second inner combined chute and bag-clamping members located within said first and second outer bag-clamping members, and first and second opposed chute sides on said first and second inner combined chute and bag-clamping members, respectively.

13. A carousel bagger as set forth in claim 12 wherein at least one of said first and second opposed chute sides includes a lower portion which is substantially vertical, and an upper portion which extends outwardly from said lower portion.

14. A carousel bagger as set forth in claim 13 wherein said first and second opposed chute sides include lower portions which are substantially vertical and upper portions which extend outwardly from said lower portions.

15. A carousel bagger as set forth in claim 14 wherein said upper portions are located at different levels.

16. A carousel bagger as set forth in claim 15 wherein said upper portions extend outwardly from said substantially vertical portions at different angles.

17. A carousel bagger comprising a frame, a rotatable table mounted on said frame, a plurality of troughs mounted on said table, inner and outer ends on said troughs, side walls on said troughs, a bottom wall in each of said troughs, a pivotal mounting securing each of said bottom walls proximate said outer ends of each of said troughs, a cam track, and a linkage between said cam track and each of said bottom walls for pivoting said bottom walls about said pivotal mounting, said bottom wall comprising two elongated sections which are at an angle to each other longitudinally of said bottom wall.

18. A carousel bagger as set forth in claim 17 wherein said side walls are fixedly secured to said table.

19. A carousel bagger as set forth in claim 18 wherein said linkage includes a cam follower mounted on said table for each of said troughs, and a connection between each of said cam followers and said bottom walls.

20. A carousel bagger as set forth in claim 19 wherein each of said cam followers comprises an elongated rod, a first roller mounted at one end of said elongated rod for engaging said cam track, and wherein said connection comprises a second roller mounted at the other end of said elongated rod for engaging said bottom wall.

21. A carousel bagger as set forth in claim 20 including bag-clamping members mounted on said table proximate each of said outer ends of said troughs.

22. A carousel bagger as set forth in claim 21 wherein said bag-clamping members include spaced first and second outer bag-clamping members, and movable first and second inner combined chute and bag-clamping members located within said first and second outer bag-clamping members, and first and second opposed chute sides on said first and second inner combined chute and bag-clamping members, respectively.

23. A carousel bagger as set forth in claim 22 wherein at least one of said first and second opposed chute sides includes a lower portion which is substantially vertical, and an upper portion which extends outwardly from said lower portion.

24. A carousel bagger as set forth in claim 22 wherein said first and second opposed chute sides include lower portions which are substantially vertical and upper portions which extend outwardly from said lower portions.

25. A carousel bagger as set forth in claim 24 wherein said upper portions are located at different levels.

26. A carousel bagger as set forth in claim 25 wherein said upper portions extend outwardly from said substantially vertical portions at different angles.

27. A carousel bagger as set forth in claim 24 wherein said upper portions extend outwardly from said substantially vertical portions at different angles.

28. A carousel bagger as set forth in claim 17 including bag-clamping pads mounted on said table proximate each of said outer ends of said troughs.

29. A carousel bagger as set forth in claim 28 wherein said bag-clamping pads include outer pads and movable inner pads located within said stationery pads, and opposed chute sides secured to said inner pads.

30. A carousel bagger as set forth in claim 29 wherein said opposed chute sides include lower portions which are substantially vertical and upper portions which flare outwardly from said lower portions.

31. A carousel bagger as set forth in claim 30 wherein said upper portions are located at different levels.

32. A carousel bagger as set forth in claim 31 wherein said upper portions extend outwardly from said substantially vertical portions at different angles.

33. A carousel bagger as set forth in claim 30 wherein said upper portions extend outwardly from said substantially vertical portions at different angles.

34. A carousel bagger as set forth in claim 29 wherein at least one of said first and second opposed chute sides includes a lower portion which is substantially vertical, and an upper portion which extends outwardly from said lower portion.

35. A carousel bagger comprising a frame, a rotatable table mounted on said frame, a plurality of troughs mounted on said table for rotation therewith, side walls on said troughs fixedly mounted on said table, a bottom wall in each of said troughs, and a pivotal mounting securing each of said bottom walls relative to said side walls.

36. A carousel bagger as set forth in claim 35 wherein said bottom wall comprises first and second sections extending lengthwise thereof, and an angle between said first and second sections.

37. A carousel bagger as set forth in claim 36 wherein said angle is an obtuse angle.

38. A carousel bagger as set forth in claim 36 including a modifier plate, a third section on said modifier plate overlying said first section, and a second angle between said third section and said second section which is different than said angle between said first section and said second section.

39. A carousel bagger as set forth in claim 38 including a bottom section on said modifier plate which underlies said third section and fits onto said first section.

40. A carousel bagger as set forth in claim 38 including a first rear wall on said trough, and a second rear wall on said modifier plate which fits along said first rear wall.

41. A carousel bagger as set forth in claim 40 including a clip portion on said second rear wall.

42. A carousel bagger comprising a frame, a rotatable table mounted on said frame, a plurality of troughs mounted on said table for rotation therewith, a bottom wall and side walls on each of said troughs, a pivotal mounting securing each of said bottom walls relative to said side walls, a cam track having an entry portion, a linkage between said cam track and each of said bottom walls for pivoting said bottom walls about said pivotal mounting, and a wheel proximate said entry portion for providing a pivotal lifting and dropping of said bottom walls prior to the subsequent pivoting of said bottom wall as said linkage traverses said cam track beyond said entry portion.

43. A carousel bagger as set forth in claim 42 including an adjustable mounting for said wheel.

44. A carousel bagger as set forth in claim 43 wherein said linkage includes a cam follower mounted on said table for each of said troughs, and a connection between each of said cam followers and said bottom walls.

45. A carousel bagger as set forth in claim 44 wherein each of said cam followers comprises an elongated rod, a first roller mounted at one end of said elongated rod for engaging said cam track, and a second roller mounted at the other end of said elongated rod for engaging said bottom wall.

46. A carousel bagger as set forth in claim 42 wherein said linkage includes a cam follower mounted on said table for each of said troughs, and a connection between each of said cam followers and said bottom walls.

47. A carousel bagger as set forth in claim 46 wherein each of said cam followers comprises an elongated rod, a first roller mounted at one end of said elongated rod for engaging said cam track, and a second roller mounted at the other end of said elongated rod for engaging said bottom wall.

48. A carousel bagger as set forth in claim 42 wherein said bottom wall includes first and second sections extending longitudinally thereof, and an angle between said first and second sections.

49. A carousel bagger as set forth in claim 48 including a modifier plate, a third section on said modifier plate overlying said first section, and a second angle between said third section and said second section which is different than said angle between said first section and said second section.

50. A carousel bagger as set forth in claim 49 including a bottom section on said modifier plate which underlies said third section and fits onto said first section.

51. A carousel bagger as set forth in claim 49 including a first rear wall on said trough, and a second rear wall on said modifier plate which fits along said first rear wall.

52. A carousel bagger as set forth in claim 48 including bag-clamping pads mounted on said table proximate each of said outer ends of said troughs.

53. A carousel bagger as set forth in claim 52 wherein said bag-clamping pads include outer pads and movable inner pads located within said stationery pads, and opposed chute sides secured to said inner pads.

54. A carousel bagger as set forth in claim 53 wherein at least one of said first and second opposed chute sides includes a lower portion which is substantially vertical, and an upper portion which extends outwardly from said lower portion.

55. A carousel bagger as set forth in claim 53 wherein said first and second opposed chute sides include lower portions which are substantially vertical and upper portions which extend outwardly from said lower portions.

56. A carousel bagger as set forth in claim 55 wherein said upper portions are located at different levels.

57. A carousel bagger as set forth in claim 55 wherein said upper portions extend outwardly from said substantially vertical portions at different angles.

58. A carousel bagger as set forth in claim 52 wherein said upper portions extend outwardly from said substantially vertical portions at different angles.

59. A carousel bagger comprising a frame, a rotatable table mounted on said frame, a plurality of troughs mounted on said table for rotation therewith, side walls on said troughs fixedly mounted on said table, a bottom wall in each of said troughs, a pivotal mounting securing each of said bottom walls on said table relative to said side walls, first and second spaced outer bag-clamping members mounted on said table, movable first and second inner combined chute and bag-clamping members mounted on said table and located within said first and second outer bag-clamping members, and first and second opposed chute sides on said first and second inner combined chute and bag-clamping members.

60. A carousel bagger as set forth in claim 59 wherein at least one of said first and second opposed chute sides includes a lower portion which is substantially vertical, and an upper portion which extends outwardly from said lower portion.

61. A carousel bagger as set forth in claim 59 wherein said first and second opposed chute sides include lower portions which are substantially vertical and upper portions which extend outwardly from said lower portions.

62. A carousel bagger as set forth in claim 61 wherein said upper portions are located at different levels.

63. A carousel bagger as set forth in claim 62 wherein said upper portions extend outwardly from said substantially vertical portions at different angles.

64. A carousel bagger as set forth in claim 63 wherein said upper portions extend outwardly from said substantially vertical portions at different angles.

65. A carousel bagger comprising a frame, a rotatable table mounted on said frame, a plurality of troughs, side walls on said troughs, bottom walls on said troughs, a pivotal mounting securing each bottom wall relative to said side walls, a cam track, a linkage between said cam track and said bottom wall for pivoting said bottom wall about said pivotal mounting, and a bump-providing member secured to said cam track.

66. A carousel bagger as set forth in claim 65 wherein said bump-providing member is triangular.

* * * * *

UNITED STATES PATENT AND TRADEMARK OFFICE

CERTIFICATE OF CORRECTION

PATENT NO. : 6,701,697 B2
DATED : March 9, 2004
INVENTOR(S) : Edward B. Savigny et al.

It is certified that error appears in the above-identified patent and that said Letters Patent is hereby corrected as shown below:

Column 15,
Line 1, change “claim 52” to -- claim 53 --.

Column 16,
Line 8, change “claim 63” to -- claim 61 --.

Signed and Sealed this

Twenty-fifth Day of May, 2004

JON W. DUDAS
*Acting Director of the United States Patent and Trademark Office*